US007024270B2

(12) United States Patent
Mauer et al.

(10) Patent No.: US 7,024,270 B2
(45) **Date of Patent: *Apr. 4, 2006**

(54) RIVETING SYSTEM AND PROCESS FOR FORMING A RIVETED JOINT

(75) Inventors: Dieter Mauer, Lollar (DE); Hermann Roeser, Bierbertal (DE); Reinhold Opper, Alten-Buseck (DE); Andreas Wojcik, Braunfels (DE); Christian Schoenig, Kinsau (DE)

(73) Assignee: Newfrey LLC, Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/300,317

(22) Filed: Nov. 20, 2002

(65) Prior Publication Data

US 2003/0074102 A1 Apr. 17, 2003

Related U.S. Application Data

(60) Continuation of application No. 09/824,872, filed on Apr. 3, 2001, now Pat. No. 6,502,008, which is a division of application No. 09/358,751, filed on Jul. 21, 1999, now Pat. No. 6,276,050, which is a continuation-in-part of application No. 09/119,255, filed on Jul. 20, 1998, now abandoned.

(30) Foreign Application Priority Data

Jul. 21, 1997 (DE) ..... 197 31 222

(51) Int. Cl.
*G06F 19/00* (2006.01)

(52) U.S. Cl. ..... 700/175; 700/174; 700/160; 29/716

(58) Field of Classification Search ..... 700/275, 700/160, 173–175, 177, 180, 181, 95; 29/243.53, 29/525.06, 407.05, 701, 703, 715, 716, 798, 29/407.04, 407.01; 340/686.1; 227/5
See application file for complete search history.

(56) References Cited

U.S. PATENT DOCUMENTS

| | | | |
|---|---|---|---|
| 1,611,876 | A | 12/1926 | Berger |
| 2,342,089 | A | 2/1944 | Rossmann |
| 2,374,899 | A | 5/1945 | Sasgen |
| 2,465,534 | A | 3/1949 | Havener |
| 2,493,868 | A | 1/1950 | Griffin |

(Continued)

FOREIGN PATENT DOCUMENTS

| | | | |
|---|---|---|---|
| CN | 1113837 | A | 12/1995 |

(Continued)

OTHER PUBLICATIONS

Aluminum Industry the Application Magazine vol. 11, No. 5, Oct./Nov. 1992, Edwards "Pierce-&-Roll riveting—the alternative to spot-welding" pp. 24-26.*

(Continued)

*Primary Examiner*—Leo Picard
*Assistant Examiner*—Steven R. Garland
(74) *Attorney, Agent, or Firm*—Harness, Dickey & Pierce, P.L.C.

(57) ABSTRACT

Computer software for controlling a riveting system is operable to join two or more workpieces with a rivet. In another aspect of the present invention, a self-piercing rivet is employed. Still another aspect of the present invention employs an electronic control unit and one or more sensors to determine a riveting characteristic and/or an actuator characteristic.

51 Claims, 19 Drawing Sheets

U.S. PATENT DOCUMENTS

| | | | |
|---|---|---|---|
| 3,557,442 | A | 1/1971 | Speller |
| 3,811,813 | A | 5/1974 | Schut |
| 3,958,389 | A | 5/1976 | Whiteside et al. |
| 3,961,408 | A | 6/1976 | Goodsmith et al. |
| 4,044,462 | A | 8/1977 | Anselmo |
| 4,096,727 | A | 6/1978 | Gargaillo |
| 4,128,000 | A | 12/1978 | Hogenhout et al. |
| 4,132,108 | A | 1/1979 | Hogenhout |
| 4,151,735 | A | 5/1979 | McDermott |
| 4,192,058 | A | 3/1980 | Falcioni |
| 4,365,401 | A | 12/1982 | Ogren |
| 4,384,667 | A | 5/1983 | Smallegan et al. |
| 4,459,073 | A | 7/1984 | Muller |
| 4,511,074 | A | 4/1985 | Kille et al. |
| 4,543,701 | A | 10/1985 | Muller |
| 4,553,074 | A | 11/1985 | Jacquemet |
| 4,555,838 | A | 12/1985 | Muller |
| 4,574,453 | A | 3/1986 | Sawdon |
| 4,582,238 | A | 4/1986 | Bennett et al. |
| 4,615,475 | A | 10/1986 | Fuhrmeister |
| 4,620,656 | A | 11/1986 | McClay et al. |
| 4,625,903 | A | 12/1986 | Becht |
| 4,633,560 | A | 1/1987 | Muller |
| 4,662,556 | A | 5/1987 | Gidlund |
| 4,765,057 | A | 8/1988 | Muller |
| 4,858,481 | A | 8/1989 | Abraham |
| 4,901,431 | A | 2/1990 | Gast |
| 4,911,592 | A | 3/1990 | Muller |
| 4,915,558 | A | 4/1990 | Muller |
| 4,955,119 | A | 9/1990 | Bonomi et al. |
| 4,964,314 | A | 10/1990 | Wilkes |
| 4,999,896 | A | 3/1991 | Mangus et al. |
| 5,042,137 | A | 8/1991 | Speller, Sr. |
| 5,056,207 | A | 10/1991 | Ladouceur |
| 5,060,362 | A | 10/1991 | Birke et al. |
| 5,131,130 | A | 7/1992 | Eshghy |
| 5,131,255 | A | 7/1992 | Fushiya et al. |
| 5,140,735 | A | 8/1992 | Ladouceur |
| 5,169,047 | A | 12/1992 | Endres et al. |
| 5,196,773 | A | 3/1993 | Yoshikawa et al. |
| 5,201,892 | A | 4/1993 | Salter |
| 5,207,085 | A | 5/1993 | Hopkins et al. |
| 5,212,862 | A | 5/1993 | Eshghy |
| 5,216,819 | A | 6/1993 | Givler |
| 5,222,289 | A | 6/1993 | Michalewski et al. |
| 5,231,747 | A | 8/1993 | Clark et al. |
| 5,259,104 | A | 11/1993 | Givler |
| 5,277,049 | A | 1/1994 | Endo |
| 5,329,694 | A | 7/1994 | Sickels et al. |
| 5,331,831 | A | 7/1994 | Schneider |
| 5,398,537 | A | 3/1995 | Michalewski et al. |
| 5,471,729 | A | 12/1995 | Zoltaszek |
| 5,471,865 | A | 12/1995 | Michalewski et al. |
| 5,472,087 | A | 12/1995 | Rink et al. |
| 5,473,805 | A | 12/1995 | Wille |
| 5,487,215 | A | 1/1996 | Ladouceur |
| 5,491,372 | A | 2/1996 | Erhart |
| 5,502,884 | A | 4/1996 | Ladouceur |
| 5,510,940 | A | 4/1996 | Tacklind et al. |
| 5,531,009 | A | 7/1996 | Givler |
| 5,533,250 | A | 7/1996 | Ladouceur |
| 5,544,401 | A | 8/1996 | Danino |
| 5,557,154 | A | 9/1996 | Erhart |
| 5,575,166 | A | 11/1996 | Michalewski et al. |
| 5,581,587 | A | 12/1996 | Satoh et al. |
| 5,615,474 | A | 4/1997 | Kellner et al. |
| 5,655,289 | A | 8/1997 | Wille et al. |
| RE35,619 | E | 10/1997 | Muller |
| 5,673,839 | A | 10/1997 | Howard et al. |
| 5,752,305 | A | 5/1998 | Cotterill et al. |
| 5,779,127 | A | 7/1998 | Blacket et al. |
| 5,795,114 | A | 8/1998 | Schweitzer et al. |
| 5,802,691 | A | 9/1998 | Zoltaszek |
| 5,809,833 | A | 9/1998 | Newport et al. |
| 5,829,115 | A | 11/1998 | Speller, Jr. et al. |
| 5,893,203 | A | 4/1999 | Buttrick Jr. |
| 5,957,362 | A | 9/1999 | Samulowitz et al. |
| 6,011,482 | A | 1/2000 | Banks et al. |
| 6,014,804 | A | 1/2000 | Lulay et al. |
| 6,058,598 | A | 5/2000 | Dixon et al. |
| 6,067,696 | A | 5/2000 | Cecil et al. |
| 6,148,507 | A | 11/2000 | Swanson et al. |
| 6,199,271 | B1 | 3/2001 | Hahn et al. |
| 6,219,898 | B1 | 4/2001 | Kubanek et al. |
| 6,276,050 | B1 | 8/2001 | Mauer et al. |
| 6,347,449 | B1 | 2/2002 | Calkins et al. |
| 6,357,100 | B1 | 3/2002 | Speller, Jr. et al. |
| 6,385,843 | B1 | 5/2002 | Singh et al. |
| 6,502,008 | B1 * | 12/2002 | Maurer et al. ..... 700/175 |
| 6,543,121 | B1 | 4/2003 | Speller, Jr. et al. |
| 2002/0166221 | A1 * | 11/2002 | Clew ..... 29/407.02 |

FOREIGN PATENT DOCUMENTS

| | | |
|---|---|---|
| DE | 1 292 112 | 4/1969 |
| DE | 40 19 467 A1 | 1/1992 |
| DE | 42 37 621 A1 | 8/1993 |
| DE | 44 19 065 A1 | 12/1995 |
| EP | 0 129 358 | 12/1984 |
| EP | 0 130 076 B1 | 1/1985 |
| EP | 0 344 906 | 12/1989 |
| EP | 0 685 662 B1 | 12/1995 |
| EP | 0 768 128 A1 | 10/1996 |
| EP | 0 772 033 A2 | 5/1997 |
| EP | 0 922 538 A2 | 6/1999 |
| FR | 2 350 901 | 5/1976 |
| FR | 2 290 970 | 8/1997 |
| GB | 1 476 227 | 6/1977 |
| GB | 1 487 098 | 9/1977 |
| GB | 2300183 A | 10/1996 |
| JP | 49-16653 | 2/1974 |
| JP | 50-84976 | 7/1975 |
| JP | 51-135265 | 11/1976 |
| JP | 51-135319 | 11/1976 |
| JP | 52-133877 | 10/1977 |
| JP | 52-134180 | 11/1977 |
| JP | 52-135960 | 11/1977 |
| JP | 53-146866 | 11/1978 |
| JP | 56-077042 | 6/1981 |
| JP | 56-120807 | 9/1981 |
| JP | 60-94927 | 6/1985 |
| JP | 61-20910 | 2/1986 |
| JP | 63-90543 | 6/1988 |
| JP | 3-210931 | 9/1991 |
| JP | 4-169828 | 6/1992 |
| JP | 7-108497 | 4/1995 |
| SU | 1696081 A1 | 12/1991 |
| WO | WO 91/15316 | 3/1991 |
| WO | WO 93/10925 | 6/1993 |
| WO | WO 93/24258 | 12/1993 |
| WO | WO 00/07751 | 2/2000 |

OTHER PUBLICATIONS

"Weiterentwicklung der Stanzniettechnik", Lothar Budde, Wilhelm Lappe, Fritz Lliebrecht, Dietmar Suβe, 1992, pp. 310-314.

Declaration of Kenneth Edwards (with exhibits), Dec. 1998.

Affidavit of John R. Perkins (with exhibits), Dec. 1998.

Affidavit of John Russell, Dec. 1998.

aT Angewandte Technik Niettechnik + Alaternativen, 1991, pp. 34-38.

"Dubbel Taschenbuch fur den Maschinenbau", W. Beitz, K.H. Kuttner, 1981, pp. 370-371.

Lothar Budde and Wilheim Lappe, Bander Bleche Rohre 5—1991, pp. 94-100.
"Ein Angebot mit Lucken Blech '90 in Essen: Elemente und Gerate zum Fugen", Bander Bleche Rohre 1—1991, pp. 52-56, with English translation.
"Qualitatssicherung in der Niettechnik" Lothar Budde, Uwe Klemens, Wilhelm Lappe, Oct. 1990.
1.6 Riveted Joints, K. Federn, Berlin, 1.6.1 Claims. Stresses in Rivets and Plates, prior to Jul. 20, 1998, pp. 1-3.
An Offer with Gaps, Blech '90 [Plate '90] in Essen: Element and Equipment for Joining, prior to Jul. 20, 1998, pp. 1-5.
Quality Assurance in Riveting Technology, Lothar Budde, Uwe Klemens, Wilhelm Lappe, Oct. 9, 1990, pp. 1-16.
Sheet Metal Industries, Advanced Car Bodies Trigger New Fastening Technology, Oct. 1992, pp. 14, 16.
Henrob Rivet Setter Drawing, believed to have been offered for sale, publicly used or known prior to Jul. 20, 1998.
Nissan Motor Co. Ltd., Patent Abstract of Japan 07108497, Processing Gun Using Piezoelectric Element and its Control Device, Dec. 10, 1993.
German Patent No. DE 44 19 065 Abstract (English Translation), Dec. 7, 1995.
Biforce 40 System Description Installation User Manual, Ver. E2.1a (Sep. 27, 1995), Binar Elektronik AB (published prior to Apr. 1997).
European Search Report, 3 pages for EP 01 30 1512 dated May 29, 2002.

* cited by examiner

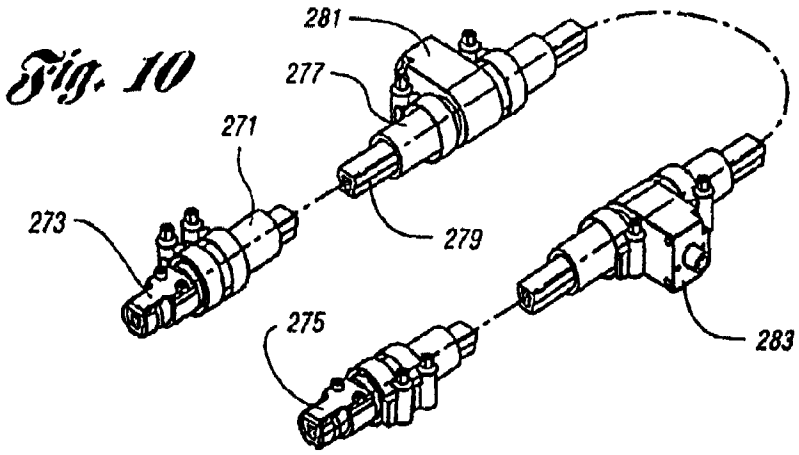
Fig. 10
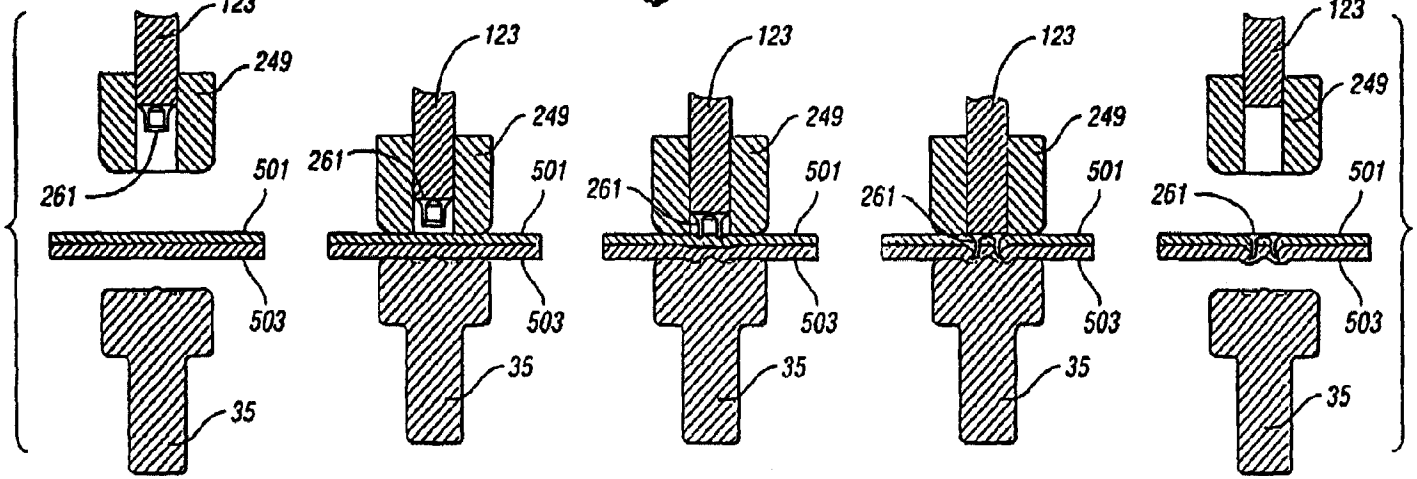
Fig. 13a
Fig. 13b
Fig. 13c
Fig. 13d
Fig. 13e

RIVETING SYSTEM AND PROCESS FOR FORMING A RIVETED JOINT

CROSS REFERENCE TO RELATED APPLICATIONS

This application is a continuation of U.S. patent application Ser. No. 09/824,872, filed on Apr. 3, 2001, now U.S. Pat. No. 6,502,008, which is a divisional of U.S. patent application Ser. No. 09/358,751, filed on Jul. 21, 1999, now U.S. Pat. No. 6,276,050, which is a continuation-in-part of U.S. patent application Ser. No. 09/119,255, filed on Jul. 20, 1998, now abandoned, which claims priority to German Application No. DE 197 31 222.5, filed on Jul. 21, 1997.

BACKGROUND

This invention relates generally to riveting and more particularly to a riveting system and a process for forming a riveted joint.

It is well known to join two or more sheets of metal with a rivet. It is also known to use self-piercing rivets that do not require a pre-punched hole. Such self-piercing or punch rivet connections can be made using a solid rivet or a hollow rivet.

A punch rivet connection is conventionally formed with a solid rivet by placing the parts to be joined on a die. The parts to be joined are clamped between a hollow clamp and the die. A plunger punches the rivet through the workpieces such that the rivet punches a hole in the parts thereby rendering pre-punching unnecessary. Once the rivet has penetrated the parts to be joined, the clamp presses the parts against the die, which includes a ferrule. The force of the clamp and the geometry of the die result in plastic deformation of the die-side part to be joined thereby causing the deformed part to partially flow into an annular groove in the punch rivet. This solid rivet is not deformed.

Traditionally, hydraulically operated joining devices are used to form such punch rivet connections. More specifically, the punching plunger is actuated by a hydraulic cylinder unit. The cost of producing such joining devices is relatively high and process controls for achieving high quality punch rivet connections has been found to be problematic. In particular, hydraulically operated joining devices are subject to variations in the force exerted by the plunger owing to changes in viscosity. Such viscosity changes of the hydraulic medium are substantially dependent on temperature. A further drawback of hydraulically operated joining devices is that the hydraulic medium, often oil, has a hydroscopic affect thereby requiring exchange of the hydraulic fluid at predetermined time intervals. Moreover, many hydraulic systems are prone to hydraulic fluid leakage thereby creating a messy work environment in the manufacturing plant.

When forming a punch connection or joint with a hollow rivet, as well as a semi-hollow rivet, the plunger and punch cause the hollow rivet to penetrate the plunger-side part to be joined and partially penetrate into the die-side part to be joined. The die is designed to cause the die-side part and rivet to be deformed into a closing head. An example of such a joined device for forming a punch rivet connection with a hollow rivet is disclosed in DE 44 19 065 A1. Hydraulically operating joining devices are also used for producing a punch rivet connection with a hollow rivet.

Furthermore, rivet feeder units having rotary drums and escapement mechanisms have been traditionally used. Additionally, it is known to use linear slides to couple riveting tools to robots.

It is also known to employ a computer system for monitoring various characteristics of a blind rivet setting system. For example, reference should be made to U.S. Pat. No. 5,661,887 entitled "Blind Rivet Set Verification System and Method" which issued to Byrne et al. on Sep. 2, 1997, and U.S. Pat. No. 5,666,710 entitled "Blind Rivet Setting System and Method for Setting a Blind Rivet Then Verifying the Correctness of the Set" which issued to Weber et al. on Sep. 16, 1997. Both of these U.S. patents are incorporated by reference herein.

SUMMARY OF THE INVENTION

In accordance with the present invention, a riveting system is operable to join two or more workpieces with a rivet. In another aspect of the present invention, a self-piercing rivet is employed. A further aspect of the present invention uses a self-piercing rivet which does not fully penetrate the die-side workpiece in an acceptable joint. Still another aspect of the present invention employs an electronic control unit and one or more sensors to determine a riveting characteristic and/or an actuator characteristic. In still another aspect of the present invention, an electric motor is used to drive a nut and spindle drive transmission which converts rotary actuator motion to linear rivet setting motion. In yet another aspect of the present invention, multiple rivet feeders can selectively provide differing types of rivets to a single riveting tool. Unique software employed to control the riveting machine is also used in another aspect of the present invention. A method of operating a riveting system is also provided.

The riveting system of the present invention is advantageous over conventional devices in that the present invention employs a very compact and mechanically efficient rotational-to-linear motion drive transmission. Furthermore, the present invention advantageously employs an electric motor to actuate the riveting punch thereby providing higher accuracy, less spilled fluid mess, lower maintenance, less energy, lower noise and less temperature induced variations as compared to traditional hydraulic drive machines. Moreover, the electronic control system and software employed with the present invention riveting system ensure essentially real time quality control and monitoring of the rivet, riveted joint, workpiece characteristics, actuator power consumption and/or actuator power output characteristics, as well as collecting and comparing historical processing trends using the sensed data.

The riveting system and self-piercing hollow rivet employed therewith, advantageously provide a high quality and repeatable riveted joint that is essentially flush with the punch-side workpiece outer surface without completely piercing through the die-side workpiece. The real-time characteristics of the rivet, joint and workpieces are used in an advantageous manner to ensure the desired quality of the final product. Furthermore, the performance characteristics may be easily varied or altered by reprogramming software set points, depending upon the specific joint or workpiece to be worked upon, without requiring mechanical alterations in the machinery. Additional advantages and features of the present invention will become apparent from the following description and appended claims, taken in conjunction with the accompanying drawings.

BRIEF DESCRIPTION OF THE DRAWINGS

FIG. 10 is a partially fragmented perspective view showing a rivet feed tube of the preferred embodiment riveting system;

FIGS. 13*a*–13*e* are a series of diagrammatic and enlarged views, similar to those of FIG. 12, showing the self-piercing riveting sequence of the preferred embodiment riveting system;

FIGS. 16 and 17 are graphs showing force versus distance riveting characteristics of the preferred embodiment riveting system;

FIGS. 18*a*–18*d* are software flow charts of the preferred embodiment riveting system.

DETAILED DESCRIPTION OF THE PREFERRED EMBODIMENT

Figure 1:
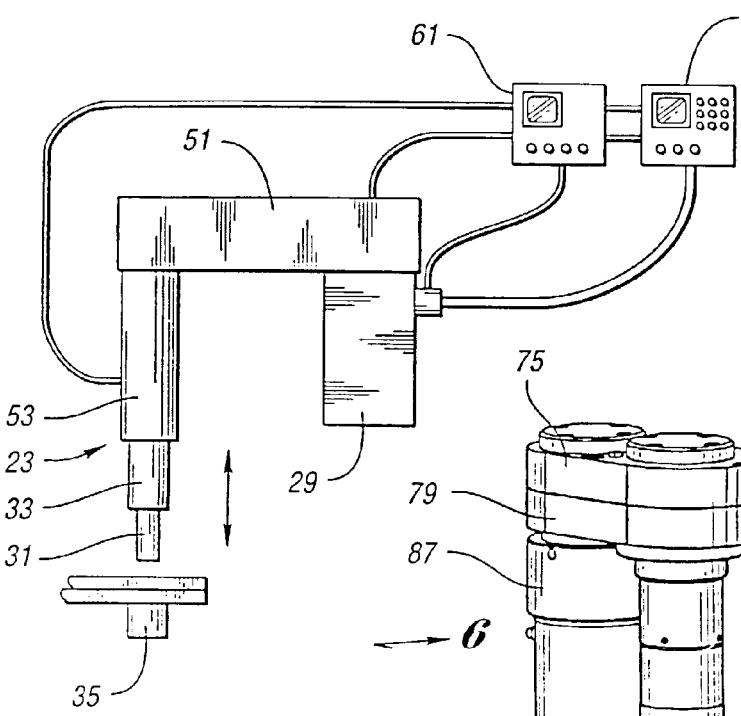
FIG. 1 is a diagrammatic view showing the preferred embodiment of the riveting system of the present invention.
Figure 2:
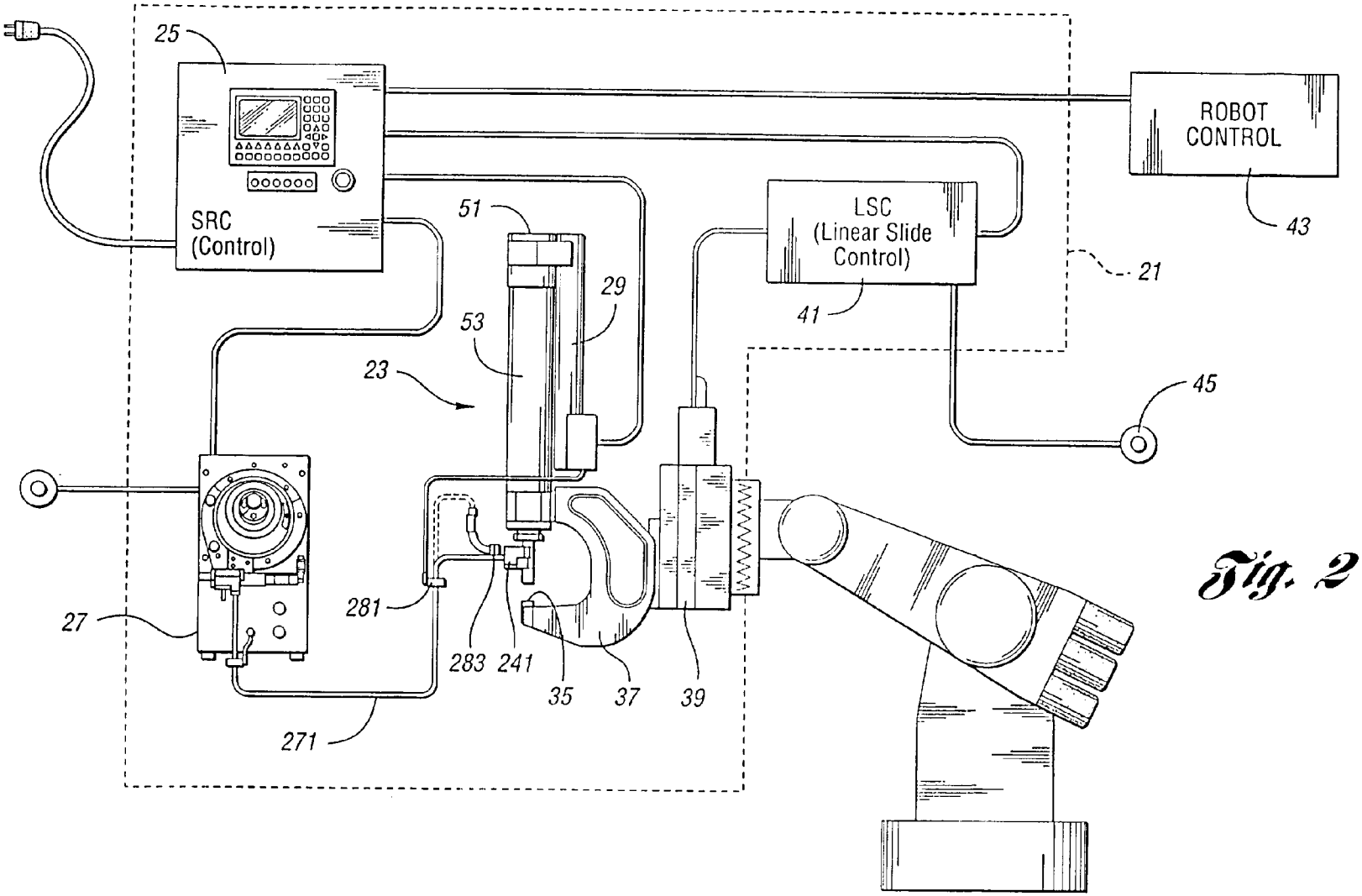
FIG. 2 is a partially diagrammatic, partially elevational view showing the preferred embodiment riveting system.

Referring to FIGS. 1 and 2, a joining device for punch rivets, hereinafter known as a riveting system 21, includes a riveting machine or tool 23, a main electronic control unit 25, a rivet feeder 27, and the associated robotic tool movement mechanism and controls, if employed. Riveting tool 23 further has an electric motor actuator 29, a transmission unit, a plunger 31, a clamp 33 and a die or anvil 35. Die 35 is preferably attached to a C-shaped frame 37 or the like. Frame 37 also couples the advancing portion of riveting tool 23 to a set of linear slides 39 which are, in turn, coupled to an articulated robot mounted to a factory floor. A linear slide control unit 41 and an electronic robot control unit 43 are electrically connected to linear slides 39 and main electronic control unit 25, respectively. The slides 39 are actuated by a pneumatic or hydraulic pressure source 45.

The transmission unit of riveting tool 23 includes a reduction gear unit 51 and a spindle drive mechanism 53. Plunger 31, also known as a punch assembly, includes a punch holder and punch, as will be described in further detail hereinafter. A data monitoring unit 61 may be part of the main controller 25, as shown in FIG. 2, or can be a separate microprocessing unit, as shown in FIG. 1, to assist in monitoring signals from the various sensors.

Figure 3:
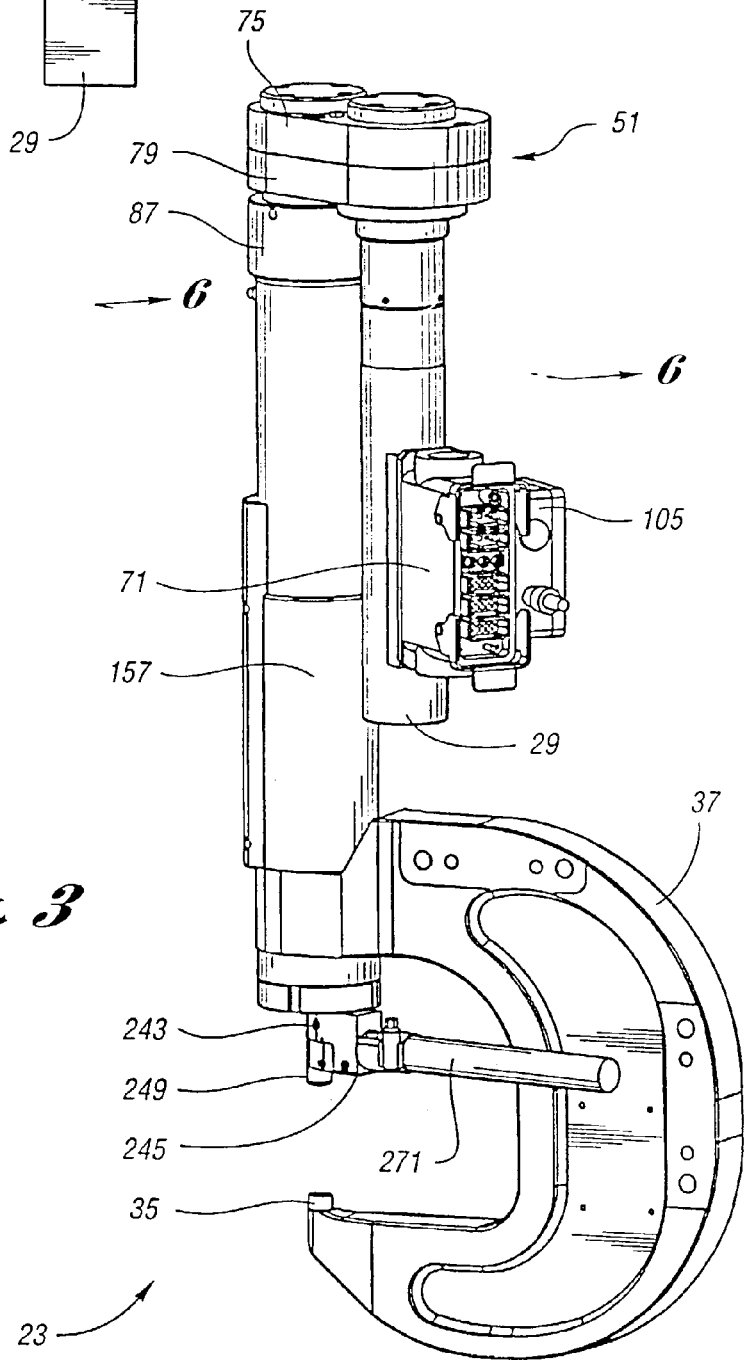
FIG. 3 is a perspective view showing a riveting tool of the preferred embodiment riveting system.
Figure 5:
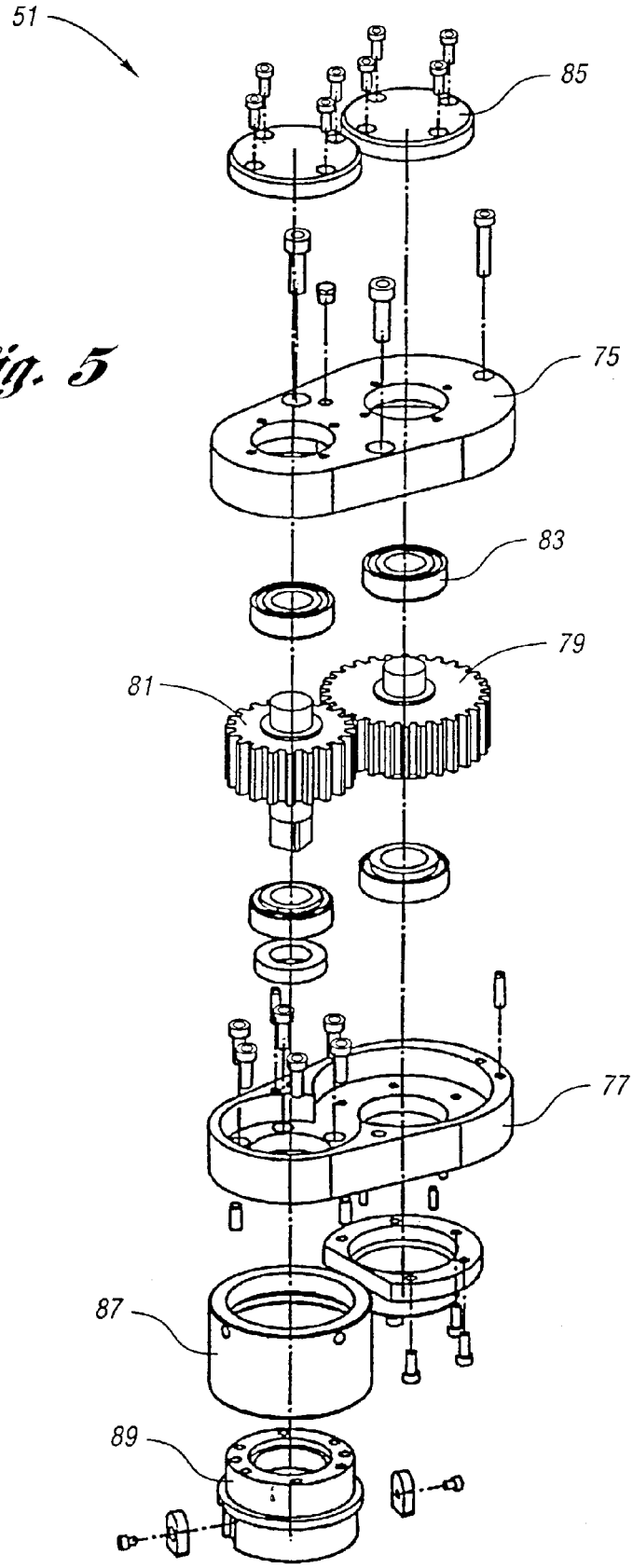
FIG. 5 is an exploded perspective view showing the gear reduction unit employed in the preferred embodiment riveting system.
Figure 6:
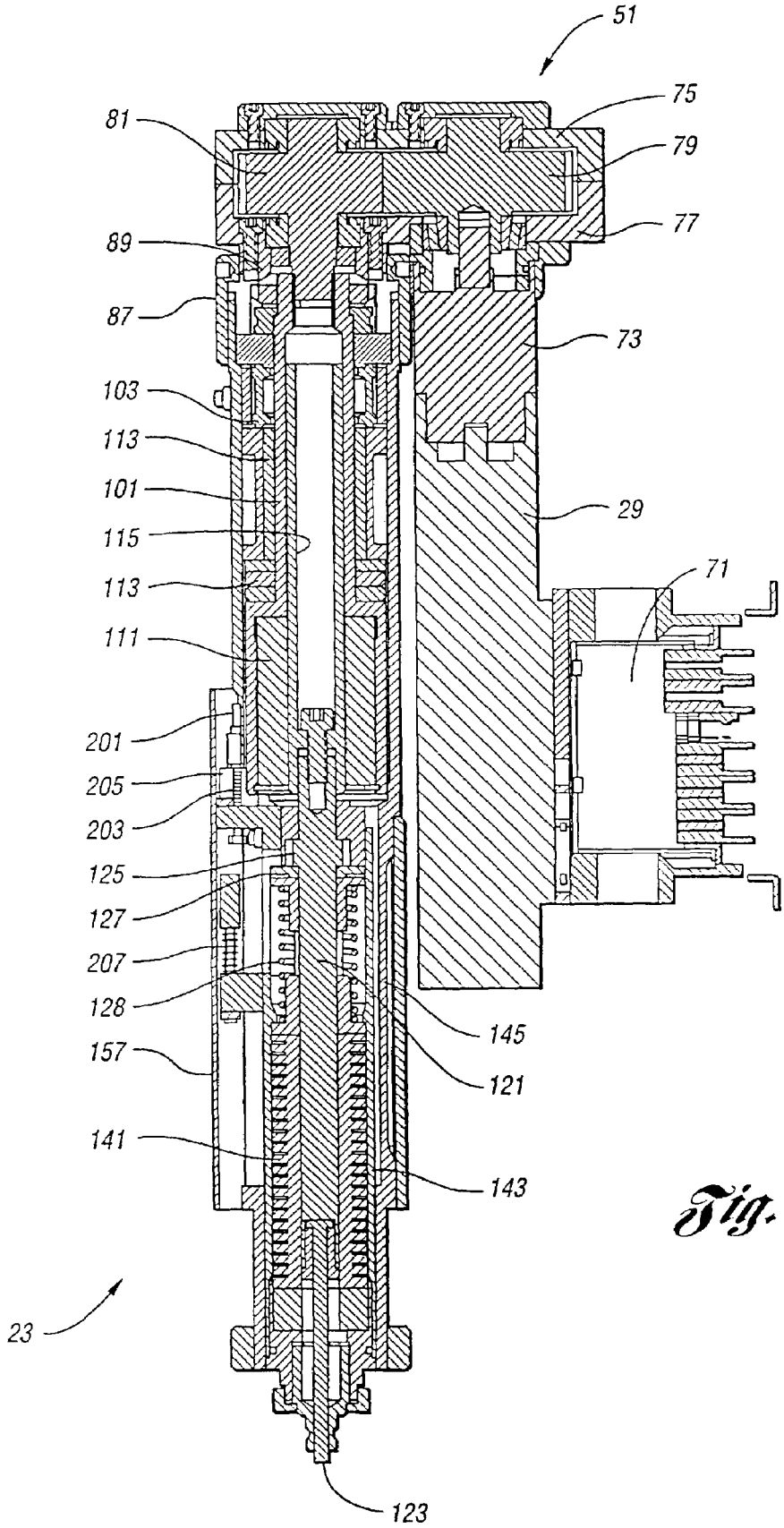
FIG. 6 is a cross sectional view, taken along line 6—6 of FIG. 3, showing the riveting tool of the preferred embodiment riveting system.

Reference is now made to FIGS. 3, 5 and 6. A main electrical connector 71 is electrically connected to main electronic control unit 25, which contains a microprocessor, a display screen, indicator lights, and input buttons. Connector 71 is also electrically connected to the other proximity switch sensors located in riveting tool 23. Electric motor 29 is of a brushless, three phase alternating current type. Energization of electric motor 29 serves to rotate an armature shaft, which in turn, rotates an output gear 73. Electric motor 29 and gear 73 are disposed within one or more cylindrical outer casings.

Reduction gear unit 51 includes gear housings 75 and 77 within which are disposed two different diameter spur gears 79 and 81. Various other ball bearings 83 and washers are located within housings 75 and 77. Additionally, removable plates 85 are bolted onto housing 75 to allow for lubrication. Spur gear 79 is coaxially aligned and driven by output gear 73, thus causing rotation of spur gear 81. Adapters 87 and 89 are also stationarily mounted to housing 77.

Figure 4:
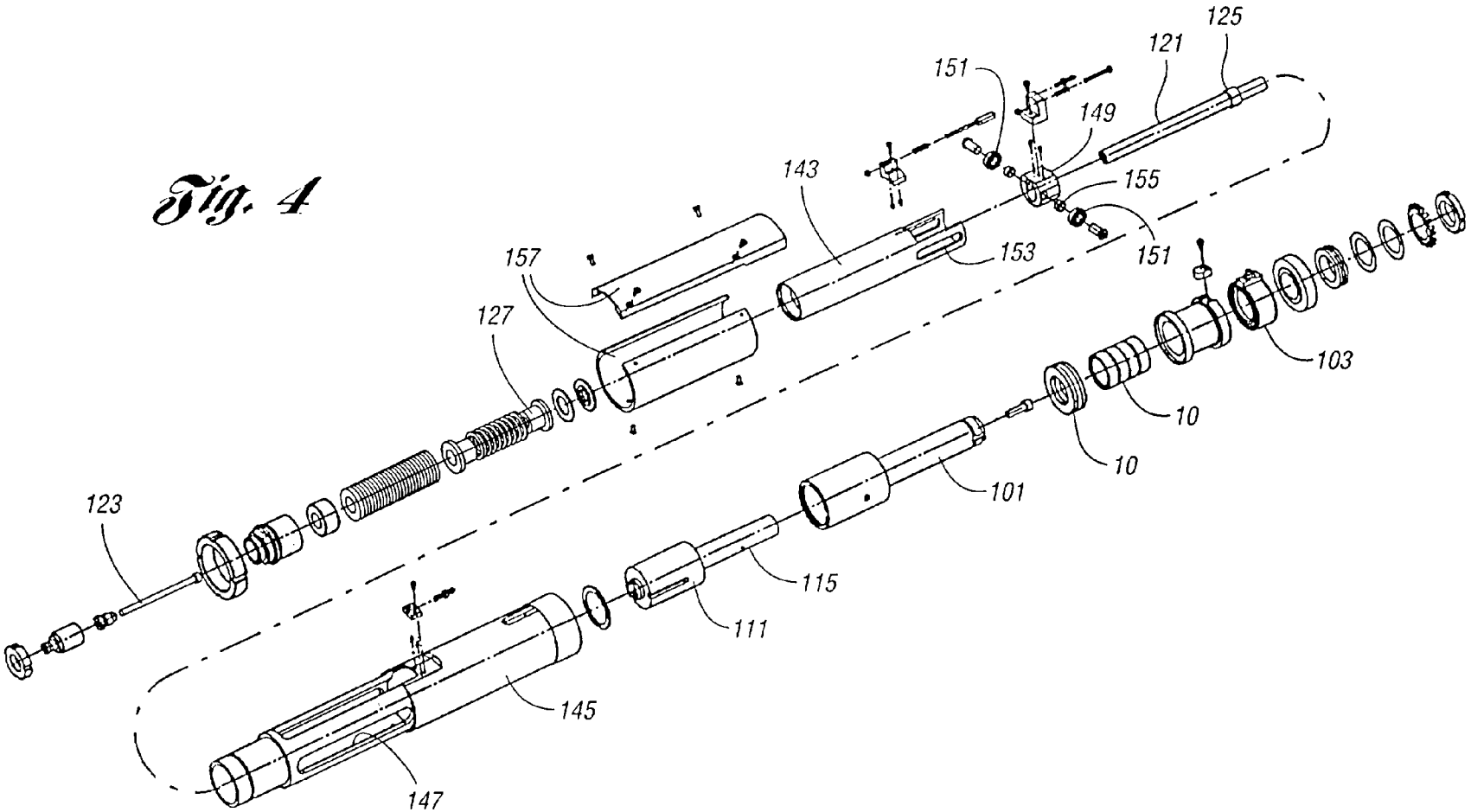
FIG. 4 is an exploded perspective view showing the nut and spindle mechanism, punch assembly, and clamp of the preferred embodiment riveting system.

FIGS. 4 and 6 show a nut housing 101 directly connected to a central shaft of spur gear 81. Therefore, rotation of spur gear 81 causes a concurrent rotation of nut housing 101. Nut housing 101 is configured with a hollow and generally cylindrical proximal segment and a generally enlarged, cylindrical distal segment. A load cell 103 is concentrically positioned around proximal segment of nut housing 101. Load cell 103 is electrically connected to a load cell interface 105 (see FIG. 3) which, in turn, is electrically connected to monitoring unit 61 (see FIG. 1). Sensor interface 105 is an interactive current amplifier. Load cell 103 is preferably a DMS load cell having a direct current bridge wherein the mechanical input force causes a change in resistance which generates a signal. Alternately, the load cell may be of a piezo-electric type.

A rotatable nut 111, also known as a ball, is directly received and coupled with a distal segment of nut housing 101 such that rotation of nut housing 101 causes a simultaneously corresponding rotation of nut 111. Ball bearings 113 are disposed around nut housing 101. A spindle 115 has a set of external threads which are enmeshed with a set of internal threads of nut 111. Hence, rotation of nut 111 causes linear advancing and retracting movement of spindle 115 along a longitudinal axis. A proximal end of a rod-like punch holder 121 is bolted to an end of spindle 115 for corresponding linear translation along the longitudinal axis. A rod-like punch 123 is longitudinally and coaxially fastened to a distal end of punch holder 121 for simultaneous movement therewith.

An outwardly flanged section 125 of punch holder 121 abuts against a spring cup 127. This causes compression of a relatively soft compression spring 128 (approximately 100–300 newtons of biasing force), which serves to drive a rivet out of the receiver and into an initial loaded position for engagement by a distal end of punch 123. A stronger compression spring 141 (approximately 8,000–15,000 newtons of biasing force) is subsequently compressed by the advancing movement of punch holder 121. The biasing action of strong compression spring 141 serves to later return and retract a clamp assembly, including a clamp 143 and nose piece, back toward gear reduction unit 51 and away from the workpieces.

A main housing 145 has a proximal hollow and cylindrical segment for receiving the nut and spindle assembly. Main housing 145 further has a pair of longitudinally elongated slots 147. A sleeve 149 is firmly secured to punch holder 121 and has transversely extending sets of rollers 151 or other such structures bolted thereto. Rollers 151 ride within slots 147 of main housing 145. Longitudinally elongated slots 153 of clamp 143 engage bushings 155 also bolted to sleeve 149. Thus, rollers 151 and slots 147 of main housing 145 serves to maintain the desired linear alignment of both punch holder 121 and clamp 143, as well as predominantly prevent rotation of these members. Additional external covers 157 are also provided. All of the moving parts are preferably made from steel.

Figure 15:
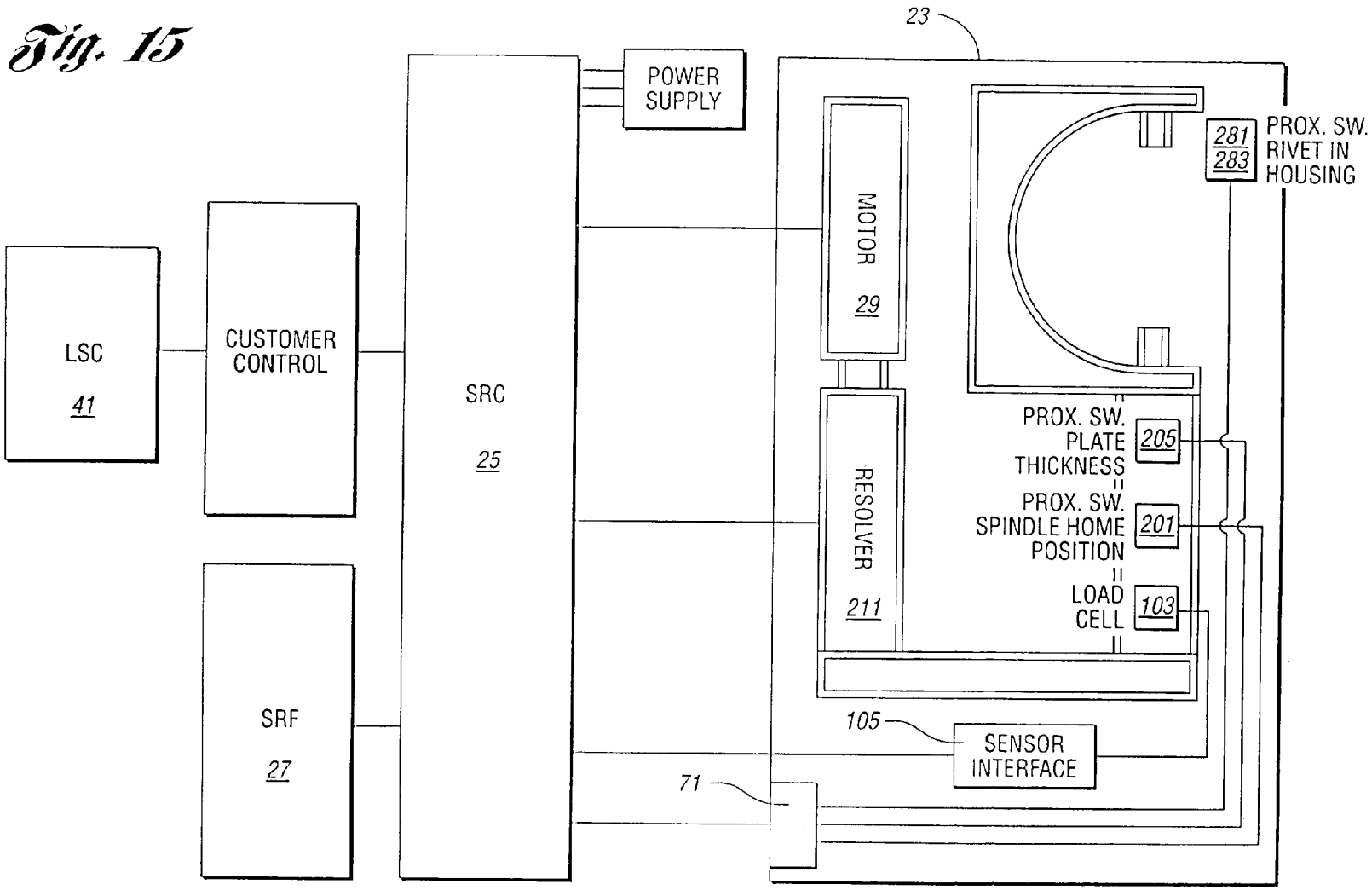

Referring to FIGS. 6 and 15, a spindle position proximity switch sensor 201 is mounted within riveting tool 23. A spring biased upper die and self-locking nut assembly 203 serves to actuate spindle position proximity switch 201 upon the spindle assembly reaching the fully retracted, home position. A plate thickness proximity switch sensor 205 is also mounted within riveting tool 23. An upper die type thickness measurement actuator and self-locking nut assembly 207 indicate the positioning of clamp 143 and thereby serve to actuate proximity sensor 205. Additional proximity switch sensors 281 and 283 are located in a feed tube for indicating the presence of a rivet therein in a position acceptable for subsequent insertion into the receiver of riveting tool 23. These proximity switches 201, 205, 281 and 283 are all electrically connected to main electronic control unit 25 via module 601. Furthermore, a resolver-type sensor 211 is connected to electric motor 29 or a member rotated therewith. Resolver 211 serves to sense actuator torque, actuator speed and/or transmission torque. The signal is then sent by the resolver to main electronic control unit 25. An additional sensor (not shown) connected to electric motor 29 is operable to sense and indicate power consumption or other electrical characteristics of the motor which indicate the performance characteristics of the motor; such a sensed reading is then sent to main electronic control unit 25.

Figure 7:
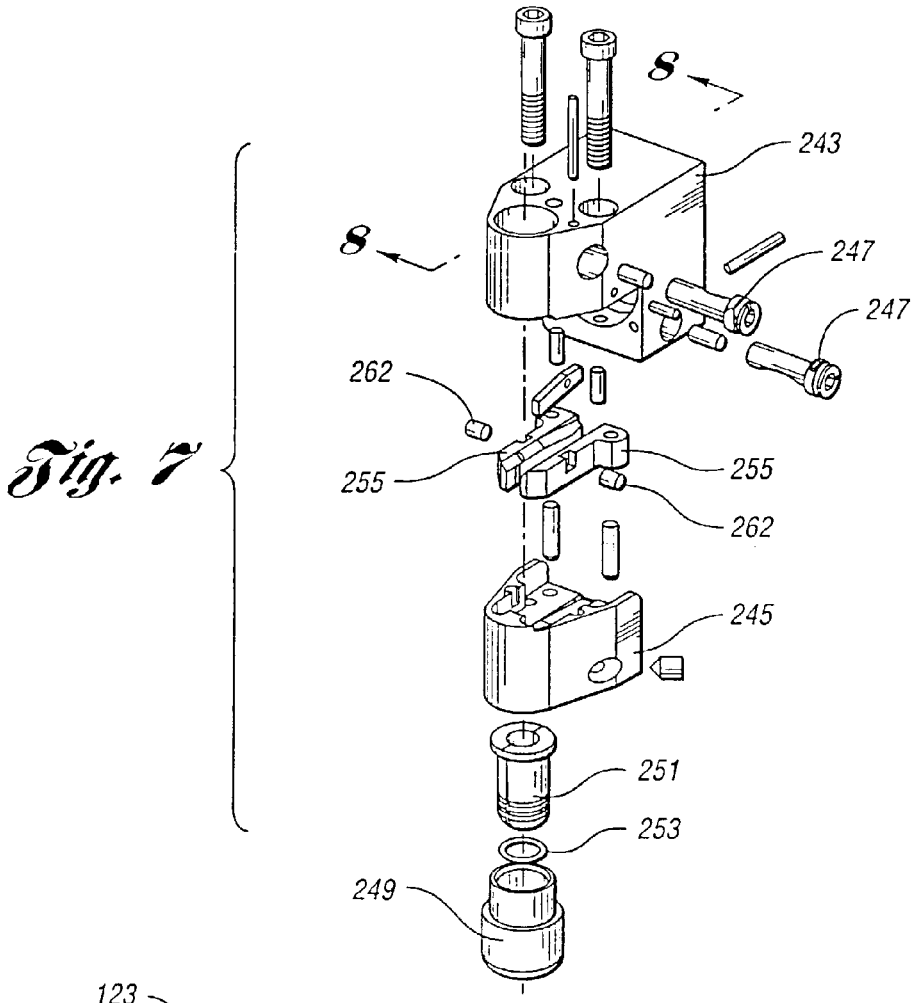
FIG. 7 is an exploded perspective view showing a receiving head of the preferred embodiment riveting system.
Figure 8:
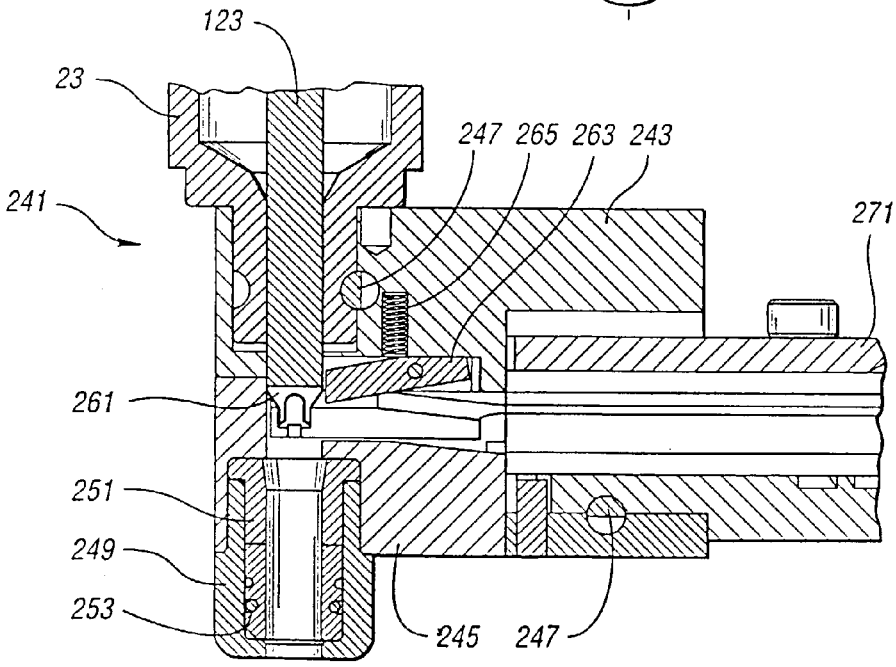
FIG. 8 is a cross sectional view showing the receiving head of the preferred embodiment riveting system.

FIGS. 7 and 8 best illustrate a receiver 241 attached to a distal end or head of riveting tool 23 adjacent punch 123. An upper housing 243 is affixed to a lower housing 245 by way of a pair of quick disconnect fasteners 247. A nose piece portion 249 of the clamp assembly is screwed into lower housing 245 and serves to retain a slotted feed channel 251, compressibly held by elastomeric O-ring 253. A pair of flexible fingers 255 pivot relative to housings 243 and 245, and act to temporarily locate a rivet 261 in a desired position aligned with punch 123 prior to insertion into the workpieces. Compression springs 262 serve to inwardly bias flexible fingers 255 toward the advancing axis of punch 123. Furthermore, a catch stop 263 is mounted to upper housing 243 by a pivot pin. Catch stop 263 is downwardly biased from upper housing 243 by way of a compression spring 265. A suitable receiver is disclosed in EPO patent publication No. 09 22 538 A2 (which corresponds to German Application No. 297 19 744.4).

FIG. 10 illustrates a feed tube 271 having end connectors 273 and 275. End connector 273 is secured to receiver 241 (see FIG. 8) and connector end 275 is secured to feeder 27 (see FIG. 2). Feed tube 271 further includes a cylindrical outer protective tube 277 and an inner rivet carrying tube 279. Inner tube 279 has a T-shaped inside profile corresponding to an outside shape of the rivet fed therethrough. Feed tube 271 is semi-flexible. Entry and exit proximity switch sensors 281 and 283, respectively, monitor the passage of each rivet through feed tube 271 and send the appropriate indicating signal to main electronic control unit 25 (see FIGS. 2 and 15). The rivets are pneumatically supplied from feeder 27 to receiver 241 through feed tube 271.

Figure 11:
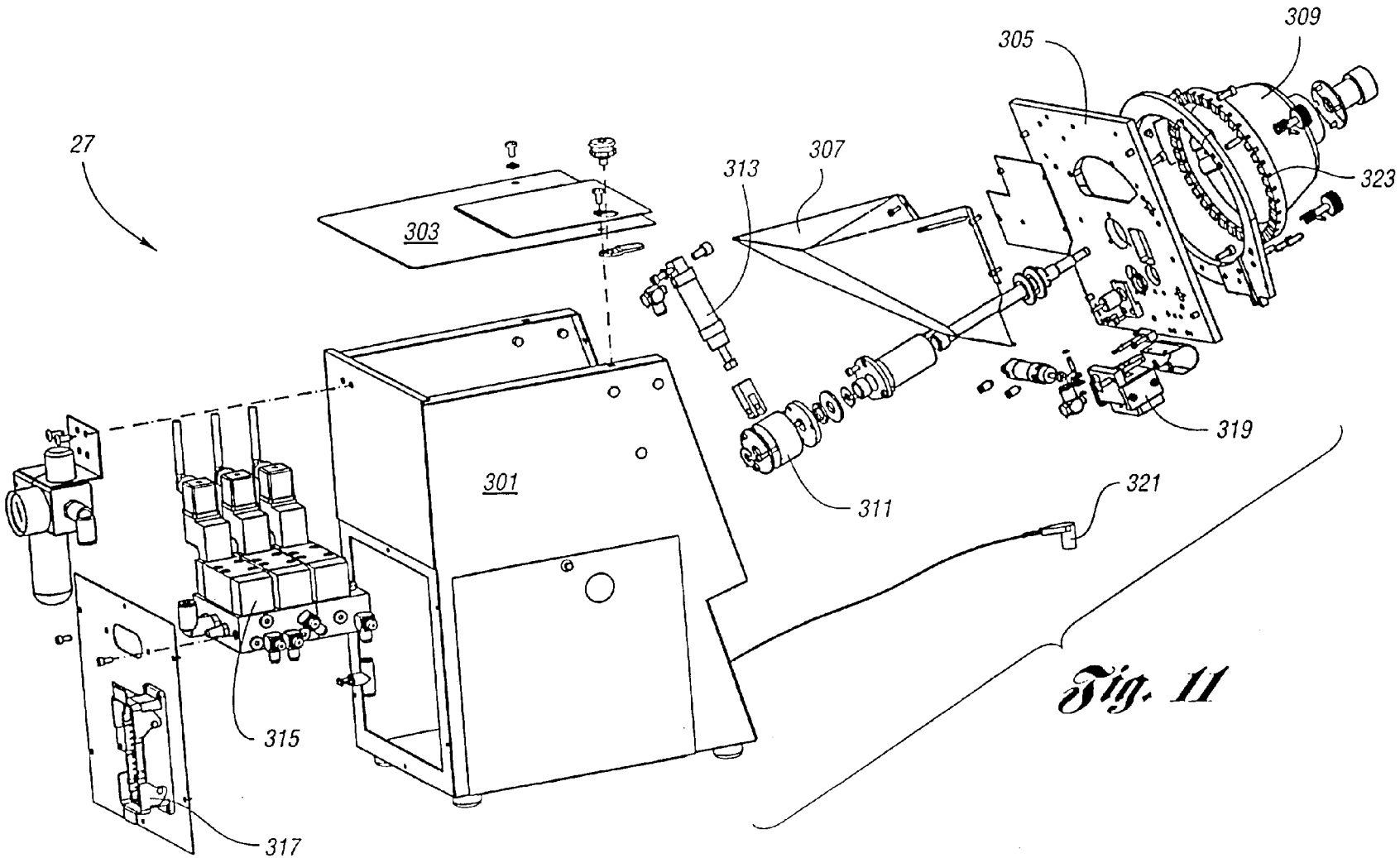
FIG. 11 is an exploded perspective view showing a feeder of the preferred embodiment riveting system.

FIG. 11 shows the internal construction of SRF feeder 27. The feeder has a stamped metal casing 301, upper cover 303 and face plate 305. Feeder 27 is intended to be stationarily mounted to the factory floor. A storage bunker 307 is attached to an internal surface of face plate 305 and serves to retain the rivets prior to feeding. A rotary bowl or drum 309 is externally mounted to face plate 305. It is rotated by way of a rotary drive unit 311 and the associated shafts. A pneumatic cylinder 313 actuates drive unit 311 and is controlled by a set of pneumatic valves 315 internally disposed within casing 301. An electrical connector 317 and the associated wire electrically connects feeder 27 to main electronic control unit 25 by way of module 601 (see FIGS. 2, 14 and 15).

A pneumatically driven, sliding escapement mechanism 319 is mounted to face plate 305 and is accessible to drum 309. A proximity switch sensor 321 is mounted to escapement mechanism 319 for indicating passage of each rivet from escapement mechanism 319. Proximity switch 321 sends the appropriate signal to the main electronic control unit through module 601. Rotation of drum 309 causes rivets to pass through a slotted raceway 323 for feeding into escapement 319 which aligns the rivets and sends them into feed tube 271 (see FIG. 10).

Figure 9:
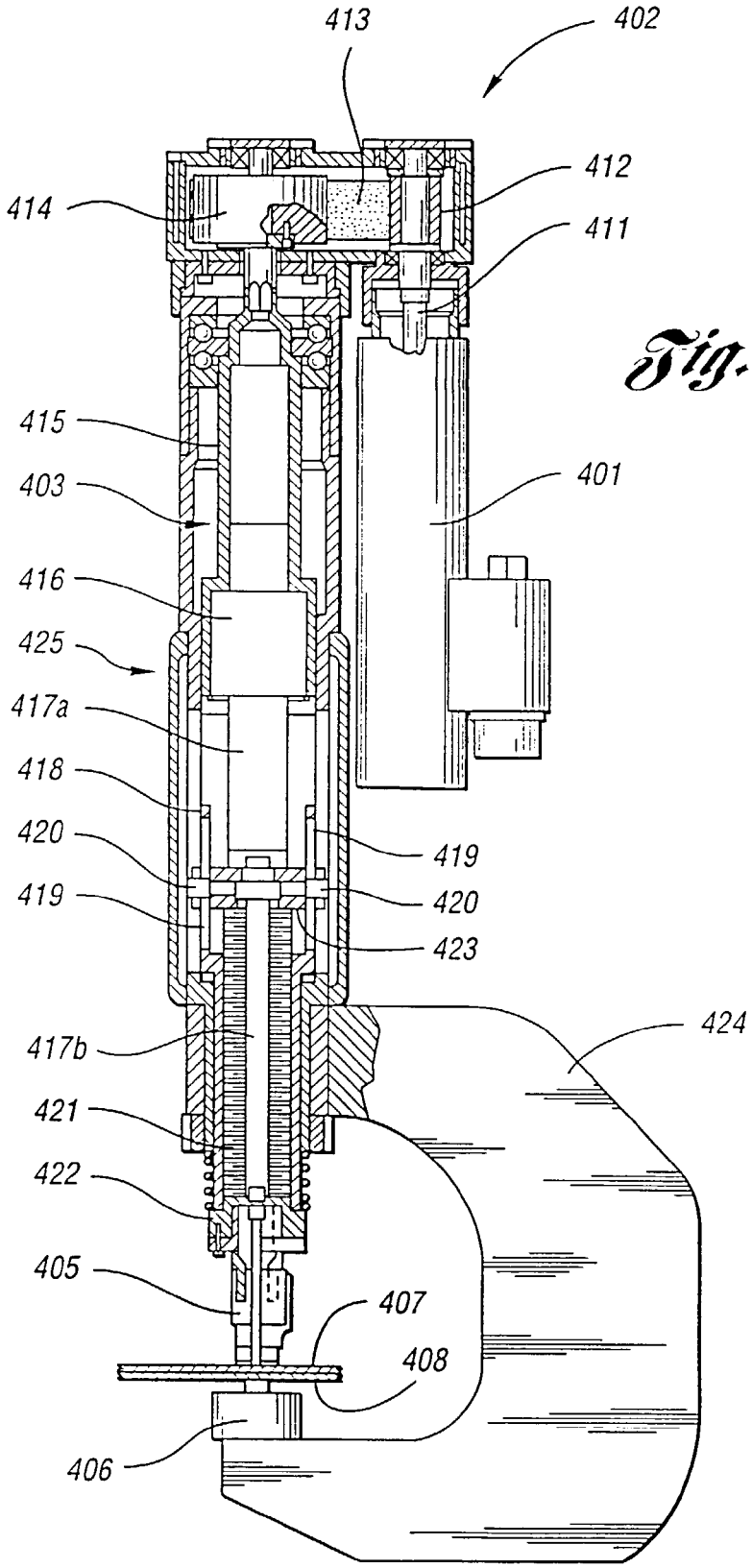
FIG. 9 is a cross sectional view, similar to FIG. 6, showing a first alternate embodiment of the riveting system.

FIG. 9 shows a first alternate embodiment riveting system. The joining device or riveting tool has an electric motor operated drive unit 401. Drive unit 401 is connected to a transmission unit 402 which is arranged in an upper end region of a housing 425. Housing 425 is connected to a framework 424.

A drive shaft 411 of drive unit 401 is connected to a belt wheel 412 of transmission unit 402. Belt wheel 412 drives a belt wheel 414 via an endless belt 413 which may be a flexible toothed belt. The diameter of belt wheel 412 is substantially smaller than the diameter of belt wheel 414, allowing a reduction in the speed of drive shaft 411. Belt wheel 414 is rotatably connected to a drive bush 415. A gear with gear wheels can also be used instead of a transmission unit 402 with belt drive. Other alternatives are also possible.

A rod 417*a* is transversely displaceable within the drive bush 415 which is appropriately mounted. The translation movement of rod 417*a* is achieved via a spindle drive 403 having a spindle nut 416 which cooperates with rod 417*a*. At the end region of rod 417*a*, remote from transmission unit 402, there is formed a guide member 418 into which rod 417*a* can be introduced. A rod 417*b* adjoins rod 417*a*. An insert 423 is provided in the transition region between rod 417*a* and rod 417*b*. Insert 423 has pins 420 which project substantially perpendicularly to the axial direction of rod 417*a* or 417*b* and engage in slots 419 in guide member 418. This ensures that rod 417*a* and 417*b* does not rotate. Rod 417*b* is connected to a plunger 404. Plunger 404 is releasably arranged on rod 417*b* so that it can be formed according to the rivets used. A stop member 422 is provided at the front end region of rod 417*b*. Spring elements 421 are arranged between stop member 422 and insert 423. Spring elements 421 are spring washers arranged in a tubular portion of guide member 418. Guide member 418 is arranged so as to slide in a housing 425. The joining device is shown in a position in which plunger 404 and clamp 405 rest on the parts to be joined 407 and 408, which also rest on a die 406.

In a punch rivet connection formed by a grooved solid rivet, the rivet is pressed through the parts to be joined 407 and 408 by plunger 404 once the workpieces have been fixed between die 406 and hold down device/clamp 405. Clamp 405 and plunger 404 effect clinching. The rivet then punches a hole in the parts to be joined, after which, clamp 405 presses against these parts to be joined. The clamp presses against the die such that the die-side part to be joined 408 flows into the groove of the rivet owing to a corresponding design of die 406. The variation of the force as a function of the displacement can be determined by the process according to the invention from the power consumption of the electric motor drive 401. For example, during the cutting process, plunger 404 and, therefore also the rivet, covers a relatively great displacement wherein the force exerted by plunger 404 on the rivet is relatively constant. Once the rivet has cut through the plunger side part to be joined 407, the rivet is spread into die 406 as the force of plunger 404 increases. The die side part to be joined 408 is deformed by die 406 during this procedure. If the force exerted on the rivet by plunger 404 is sustained, the rivet is compressed. If the head of the punch rivet lies in a plane of the plunger-side part to be joined 407, the punch rivet connection is produced. The force/displacement curve can be determined from the process data. With a known force/displacement curve which serves as a reference, the quality of a punch connection can be determined by means of the measured level of the force as a function of the displacement.

The drive unit, monitoring unit and the spindle drive can have corresponding sensors for picking up specific characteristics, the output signals of which are processed in the monitoring unit. The monitoring unit can be part of the control unit. The monitoring unit emits input signals as open and closed loop control variables to the control unit. The sensors can be displacement and force transducers which determine the displacement of the plunger as well as the force of the plunger on the parts to be joined. A sensor which measures the power consumption of the electric motor action drive unit can also be provided, as power consumption is substantially proportional to the force of the plunger and optionally of the clamp on the parts to be joined.

In this alternate embodiment, the speed of the drive unit can also be variable. Owing to this feature, the speed with which the plunger or the clamp acts on the parts to be joined or the rivet can be varied. The speed of the drive unit can be adjusted as a function of the properties of the rivet and/or the properties of the parts to be joined. The advantage of the adjustable speed of the drive unit also resides in the fact that, for example, the plunger and optionally the clamp is initially moved at high speed to rest on the parts to be joined and the plunger and optionally the clamp is then moved at a lower speed. This has the advantage of allowing relatively fast positioning of the plunger and the clamp. This also affects the cycle times of the joining device.

It is further proposed that the plunger and optionally the clamp be movable from a predeterminable rest position that can be easily changed through the computer software. The rest position of the plunger and optionally of the clamp is selected as a function of the design of the parts to be joined. If the parts to be joined are smooth metal plates, the distance between a riveting unit which comprises the plunger and the clamp and a die can be slightly greater than the thickness of the superimposed parts to be joined. If a part to be joined has a ridge, as viewed in the feed direction of the part to be joined, the rest position of the riveting unit is selected such that the ridge can be guided between the riveting unit and the die. Therefore, it is not necessary for the riveting unit always to be moved into its maximum possible end or home position.

A force or a characteristic corresponding to the force of the plunger, and optionally of the clamp, can be measured in this alternate embodiment during a joining procedure as a function of the displacement of the plunger or of the plunger and the clamp. This produces a measured level. This is compared with a desired level. If comparison shows that the measured level deviates from the desired level by a predetermined limit value in at least one predetermined range, a signal is triggered. This process control advantageously permits qualitative monitoring of the formation of a punch connection.

This embodiment of the process also compares the measured level with the desired level at least in a region in which clinching is substantially completed by the force of the plunger on a rivet. A statement as to whether a rivet has been supplied and the rivet has also been correctly supplied can be obtained by comparing the actual force/displacement trend with the desired level. The term 'correctly supplied' means a supply where the rivet rests in the correct position on the part to be joined. It can also be determined from the result of the comparison whether an automatic supply of rivets is being provided correctly.

The measured level is also compared with the desired level at least in a region in which the parts to be joined have been substantially punched by the force of the plunger on a rivet, in particular a solid rivet, and the clamp exerts a force on the plunger-side part to be joined. This has the advantage that it is possible to check whether the rivet actually penetrated the parts to be joined.

According to this embodiment of the process, the measured level is compared with the desired level, at least in a region in which a rivet, in particular a hollow rivet, substantially penetrated the plunger-side part to be joined owing to the force of the plunger and a closing head was formed on the rivet. It is thus also possible to check whether the parts to be joined also have a predetermined thickness. A comparison between the measured level and the desired level is performed, at least in a region in which a closing head is substantially formed on the rivet, in particular a hollow rivet, and clinching of the rivet takes place. It is thus possible to check whether the rivet ends flush with the surface of the plunger-side part to be joined.

Figures 12A, 12B, 12C, 12D, 12E, 12F:
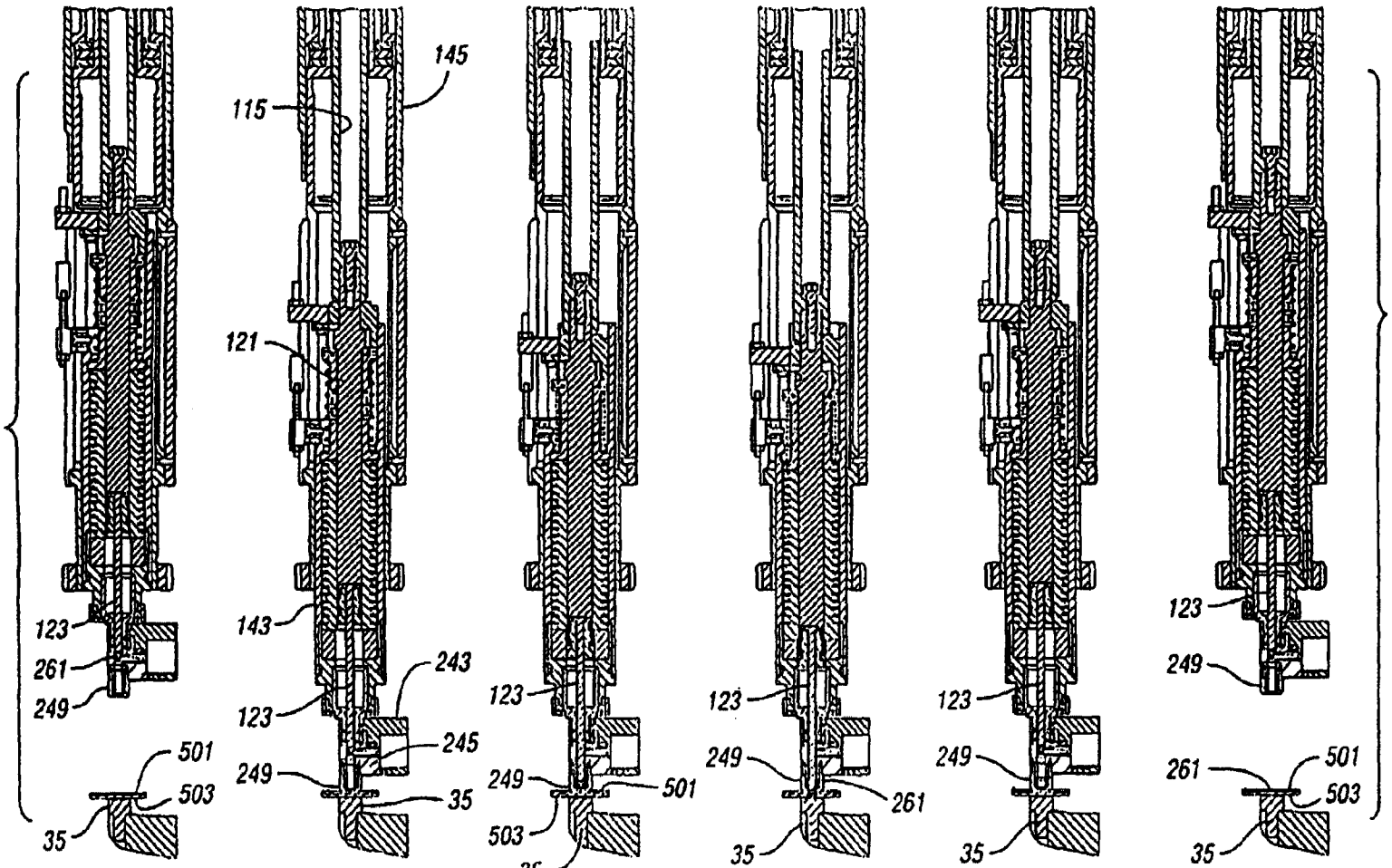
FIGS. 12*a*–12*f* are a series of cross sectional views, similar to that of FIG. 6, showing the self-piercing riveting sequence of the preferred embodiment riveting system.

Returning to the preferred embodiment, FIGS. 12*a*–12*f* and FIGS. 13*a*–13*e* show the riveting process steps employing the system of the present invention. The preferred rivet employed is of a self-piercing and hollow type which does not fully pierce through the die-side workpiece. First, FIGS. 12*a* and 13*a* show the clamp/nose piece 249 and punch 123 in retracted positions relative to workpieces 501 and 503. Workpieces 501 and 503 are preferably stamped sheet metal body panels of an automotive vehicle, such as will be found on a conventional pinch weld flange adjacent the door and window openings. The robot and linear slides will position the riveting tool adjacent the sheet metal flanges such that nose piece 249 and die 35 sandwich workpieces 501 and 503 therebetween at a target joint location. It is alternately envisioned that a manually (non-robotic) moved riveting tool or a stationary riveting tool can also be used with the present invention.

FIG. 12*b* shows clamp/nose piece 249 clamping and compressing workpieces 501 and 503 against die 35. Punch 123 has not yet begun to advance rivet 261 toward workpieces 501 and 503. At this point, the plate thickness proximity switch senses the thickness of the workpieces through actual location of the clamp assembly; the plate thickness switch sends the appropriate signal to the main controller. Next, punch 123 advances rivet 261 to a point approximately 1 millimeter above the punch-side workpiece 501. This is shown in FIGS. 12*c* and 13*b*. If the workpiece thickness dimension is determined to be within an acceptable range by the main electronic control unit then energization of the electric motor further advances punch 123 to insert rivet 261 into punch-side workpiece 501, as shown in FIG. 13*c*, and then continuously advances the rivet into die-side workpiece 503, as shown in FIGS. 12*d* and 13*d*. Die 35 serves to outwardly deform and diverge the distal end of rivet 261 opposite punch 123.

FIG. 12*e* shows the punch subsequently retracted to an intermediate position less than the full home position while clamp/nose piece 249 continues to engage punch side workpiece 501. Finally, punch 123 and clamp/nose piece 249 are fully retracted back to their home positions away from workpieces 501 and 503. This allows workpieces 501 and 503 to be separated and removed from die 35 if an acceptable riveted joint is determined by the main electronic control unit based on sensed joint characteristics. As shown in FIG. 13*e*, an acceptable riveted joint has an external head surface of rivet 261 positioned flush and co-planar with an exterior surface of punch-side workpiece 501. Also, in an acceptable joint, the diverging distal end of rivet 261 has been sufficiently expanded to engage workpiece 503 without piercing completely through the exterior surface of die-side workpiece 503.

Figure 14:
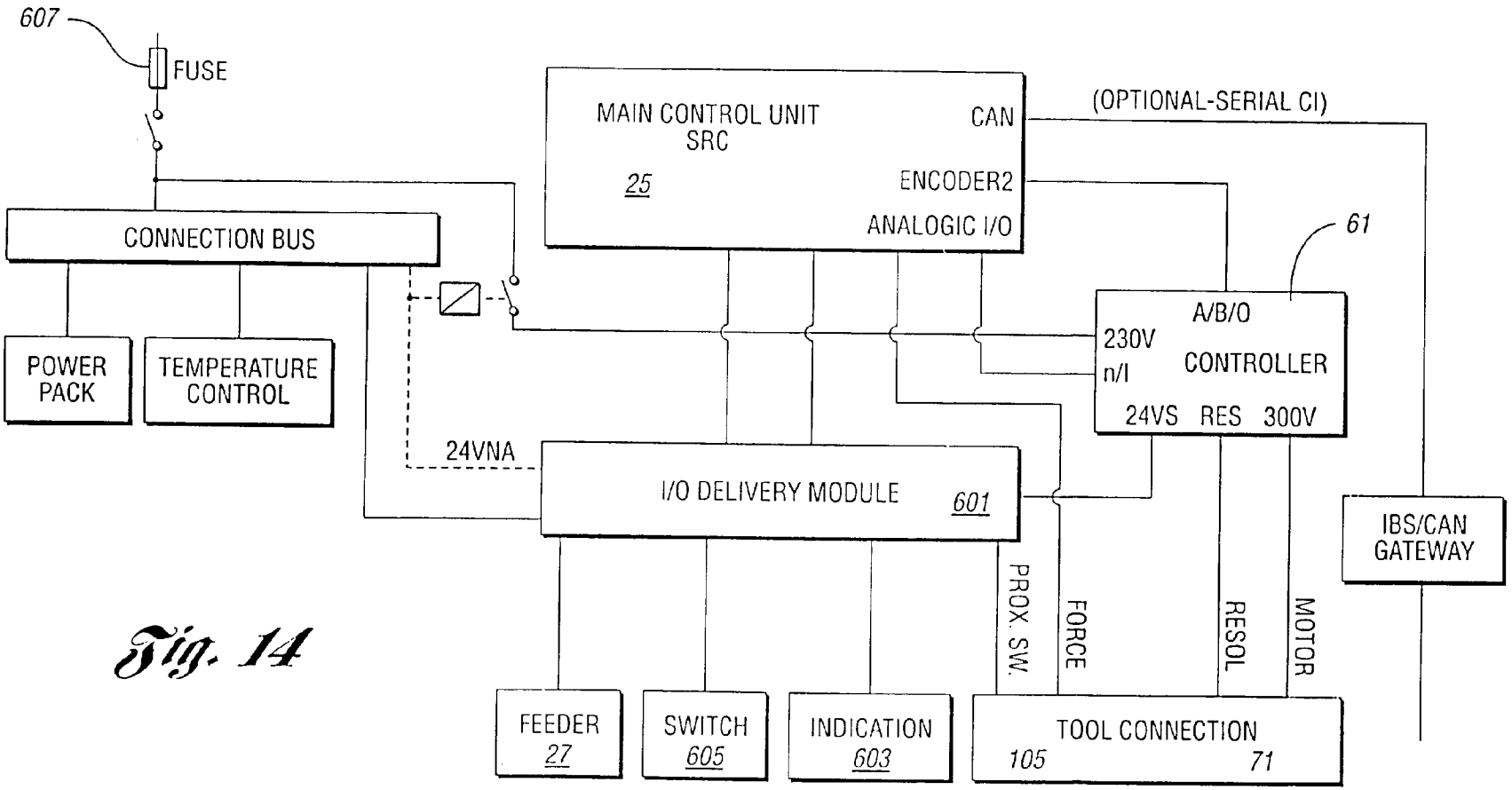
FIGS. 14 and 15 are diagrammatic views showing the control system of the preferred embodiment riveting system.

A simplified electrical diagram of the preferred embodiment riveting system is shown in FIG. 14. Main electronic control unit 25, such as a high speed industrial microprocessor computer, having a cycle time of about 0.02 milliseconds purchased from Siemons Co., has been found to be satisfactory. A separate microprocessor controller 61 is connected to main electronic control unit 25 by way of an analogic input/output line and an Encoder2 input which measures the position of the spindle through a digital signal. Controller 61 receives an electric motor signal and a resolver signal. The load cell force signal is sent directly from the tool connection 105 to the main electronic control unit 25 while the proximity switch signals (from the feeder, feed tube and spindle home position sensors) are sent from the tool connection 71 through an input/output delivery microprocessor module 601 and then to main electronic control unit 25. Input/output delivery microprocessor module 601 actuates error message indication lamps 603, receives a riveting start signal from an operator activatable switch 605 and relays control signals to feeder 27 from main electronic control unit 25. An IBS/CAN gateway transmits data from main electronic control unit 25 to a host system which displays and records trends in data such as joint quality, workpiece thickness and the like. Controller 61 is also connected to a main power supply via fuse 607.

Figure 16:
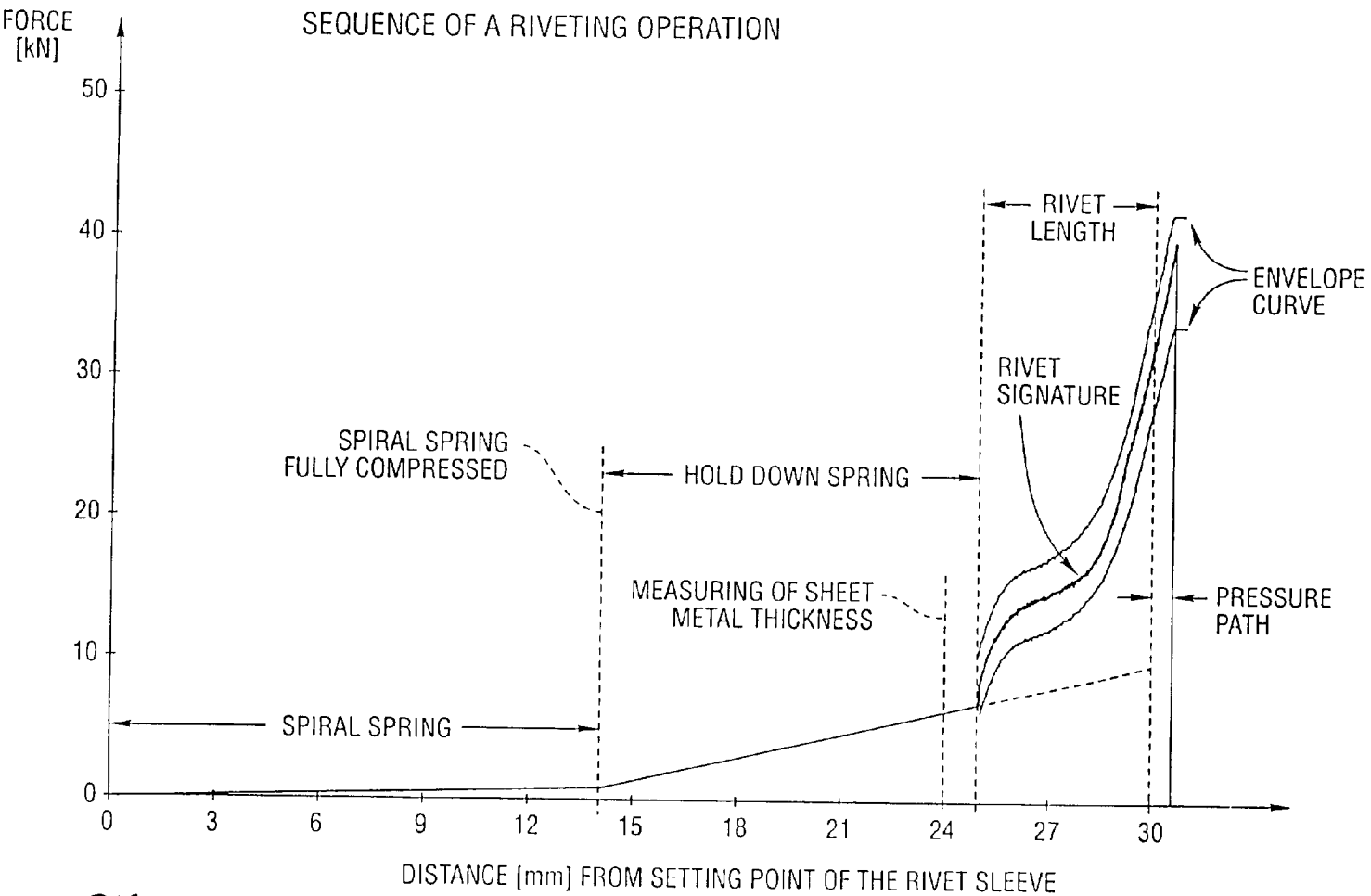
Figure 12:
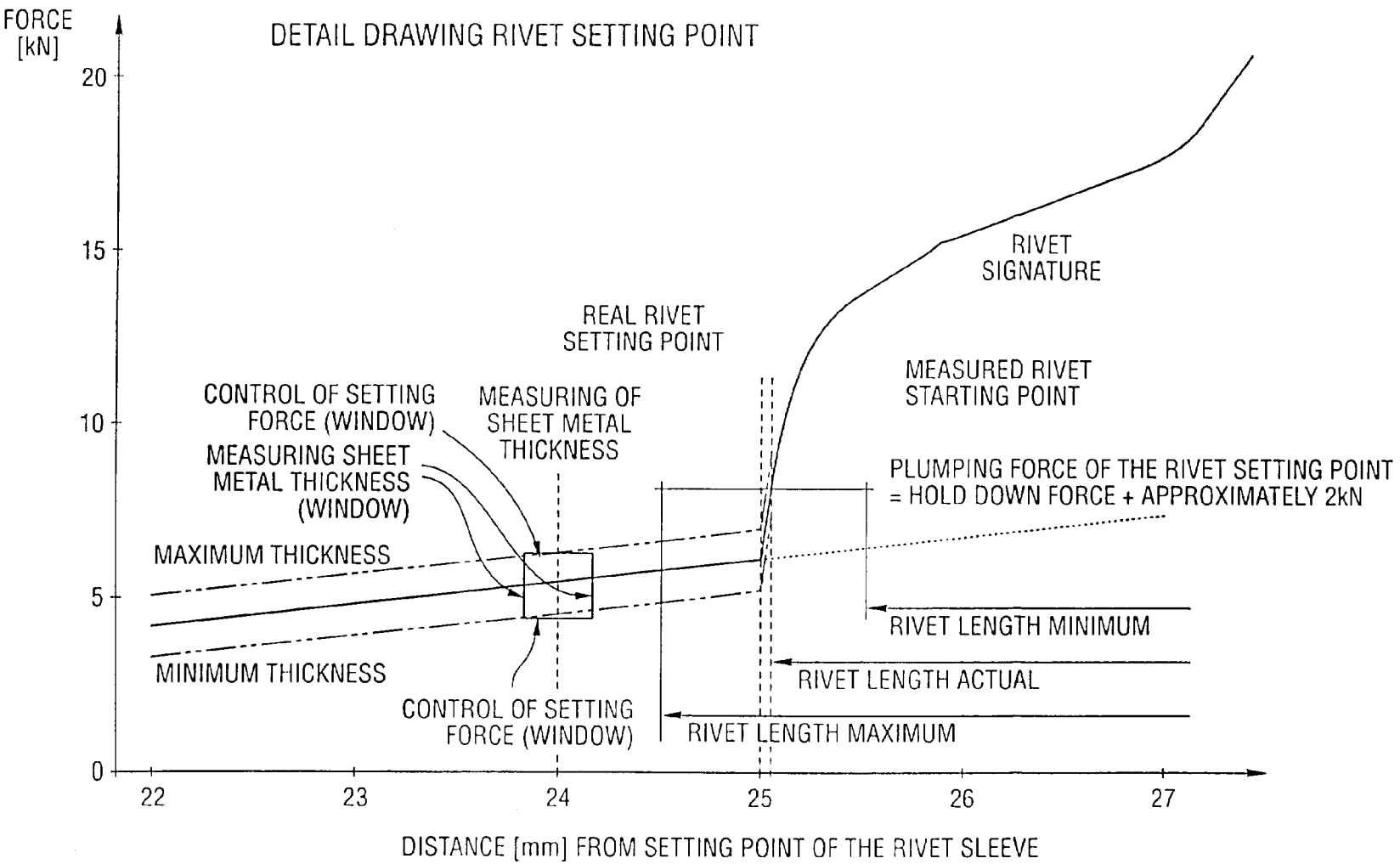
Figure 18A:
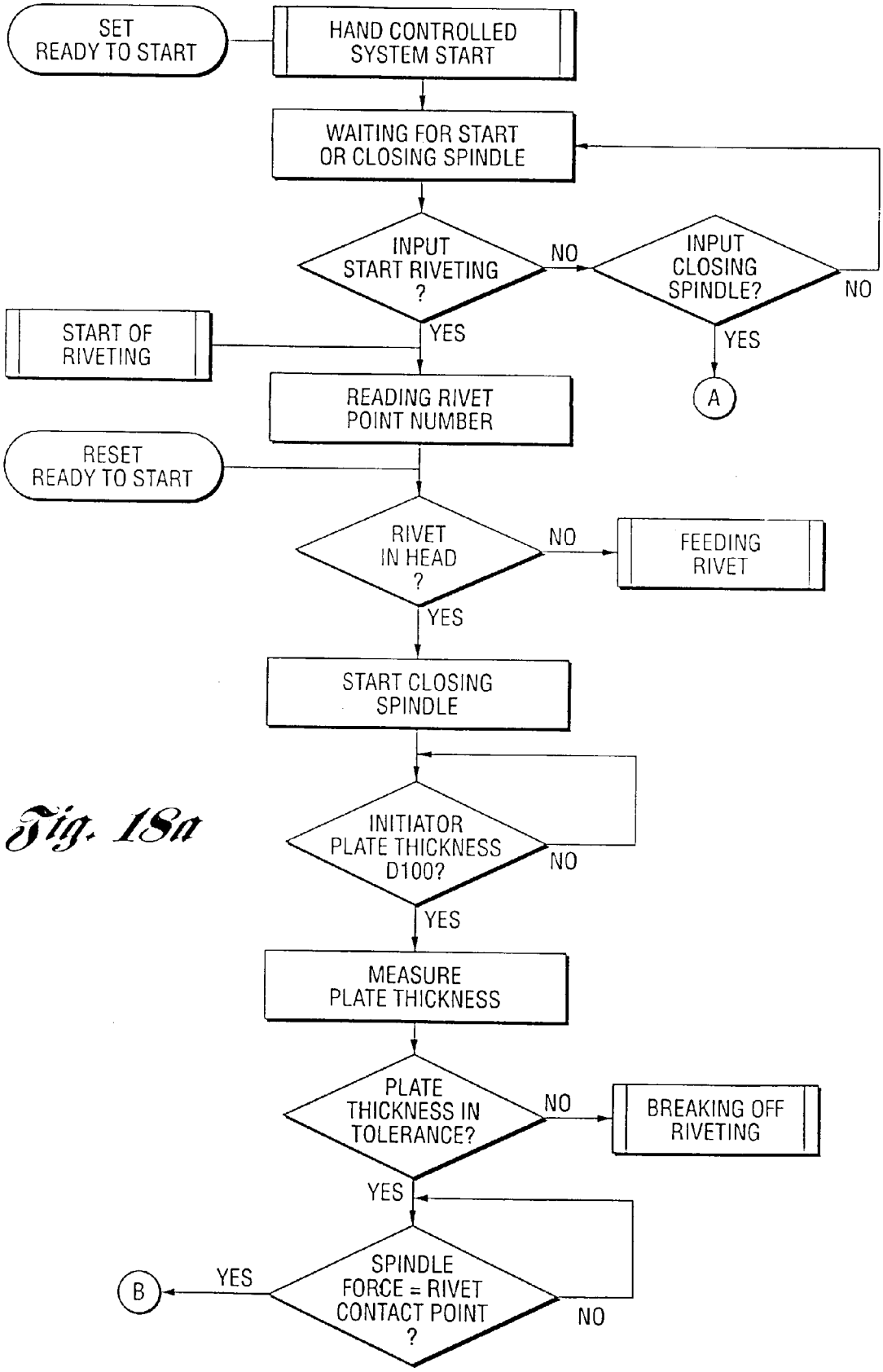
Figure 18B:
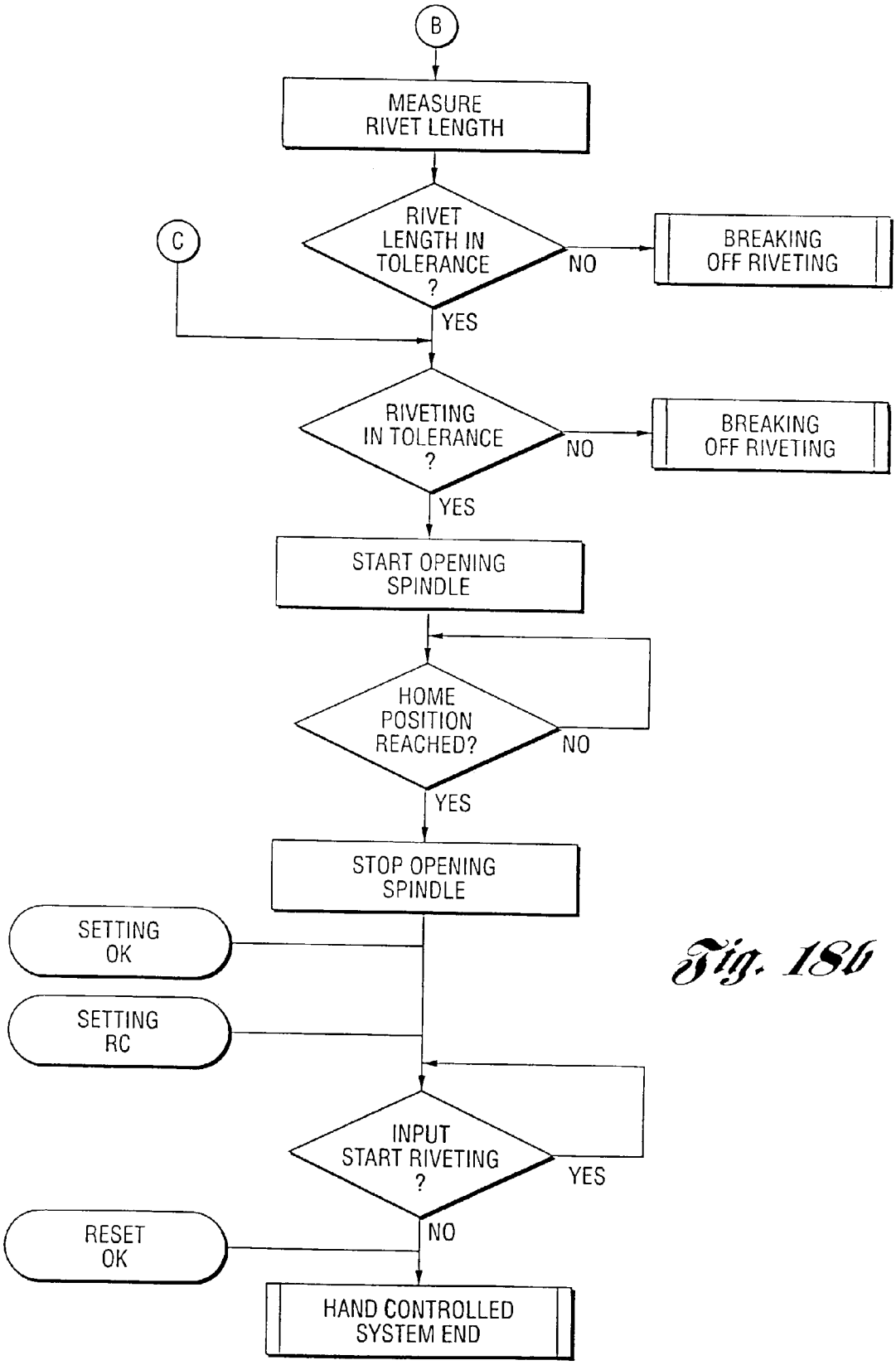
Figure 18C:
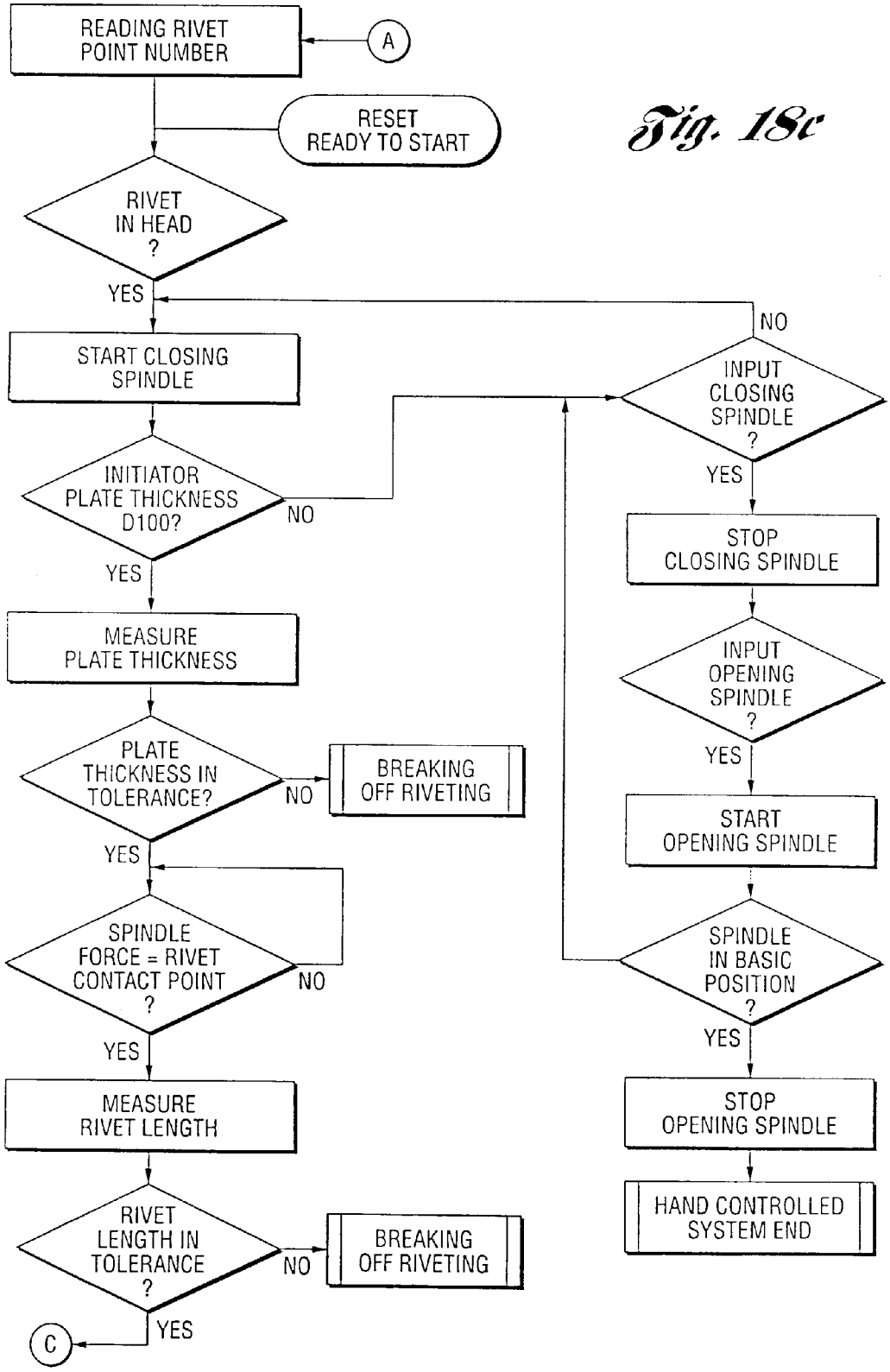
Figure 18B:
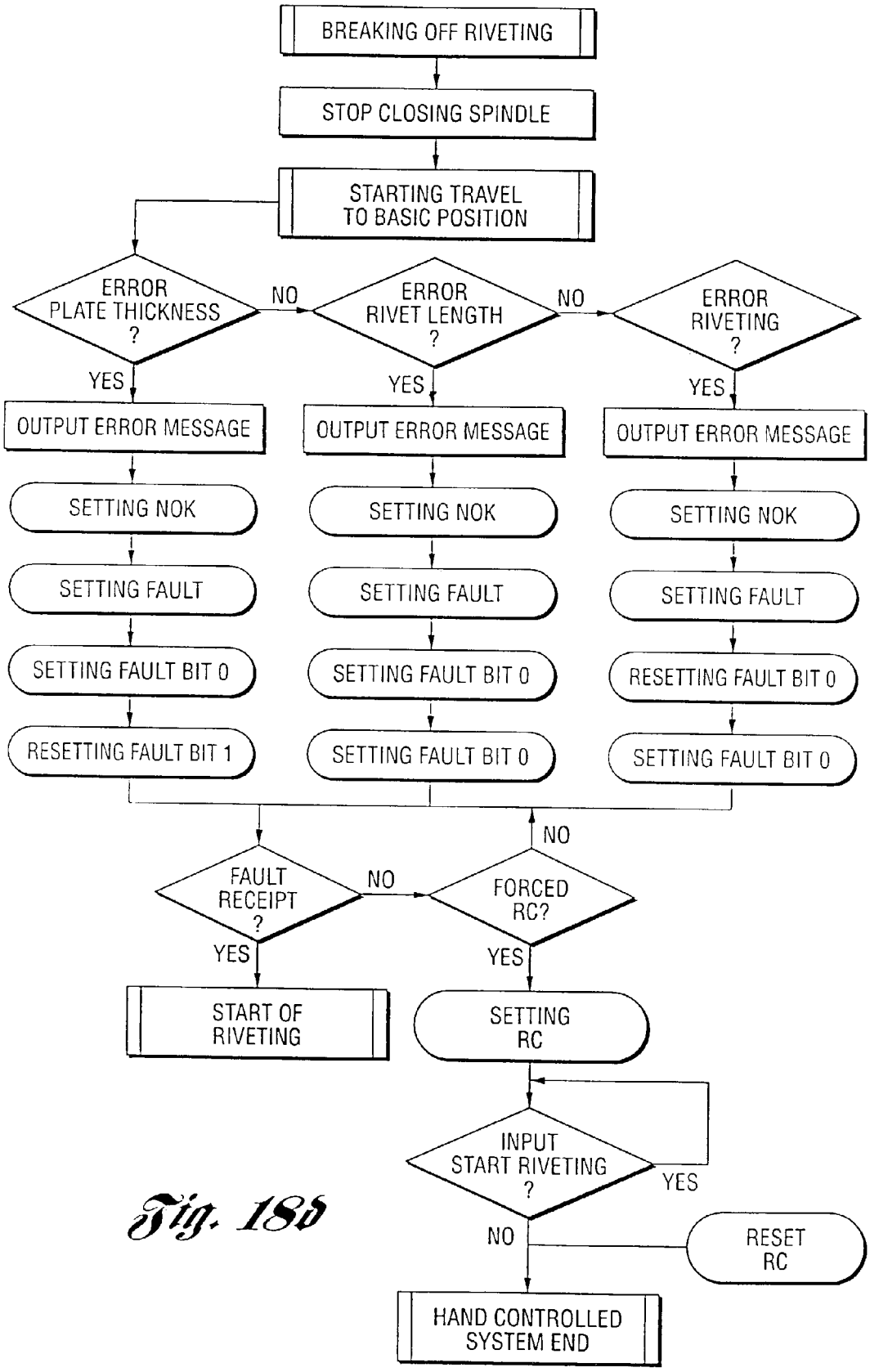

FIG. 16 is a force/distance (displacement) graph showing a sequence of a single riveting operation or cycle. The first spiral spring distance range is indicative of the force and displacement of punch 123 due to light spring 128. The next displacement range entitled hold down spring, is indicative of the force and displacement generated by heavy spring 141, clamp 143 and the associated clamping nose piece 249. Measurement of the sheet metal/workpiece thickness occurs at a predetermined point within this range, such as 24 millimeters from the home position, by way of load cell 103 interacting with main electronic control unit 25. In the next rivet length range, the rivet length is sensed and determined through load cell 103 and main electronic control unit 25. The middle line shown is the actual rivet signature sensed while the upper line shown is the maximum tolerance band and the lower line shown is the minimum tolerance band of an acceptable rivet length for use in the joining operation. If an out of tolerance rivet is received and indicated then the software will discontinue or "break off" the riveting process and send the appropriate error message.

FIG. 17 shows a force versus distance/displacement graph for the rivet setting point. The sensed workpiece thickness, the middle line, is compared to a prestored maximum and minimum thickness acceptability lines within the main electronic control unit 25. This occurs at a predetermined distance of movement by the clamp assembly from the home position or other initialized position. The rivet length (or other size or material type) signature is also indicated and measured. Load cell 103 senses force of the clamp assembly and punch assembly. The workpiece thickness is determined by comparison of a first sensed force value at a preset displacement versus a preprogrammed force value at that location. Subsequently sensed force values are also compared to preset acceptable values; these subsequent sensed force values are indicative of rivet size and joint quality characteristics. The computer is always on-line with the tool and process in a closed-loop manner. This achieves a millisecond, real time control of the process through sensed values.

FIGS. 18*a*–18*d* show a flow chart of the computer software used in the main electronic control unit 25 for the preferred embodiment riveting system of the present invention. The beginning of the riveting cycle is started through an operator actuated switch, whereafter the system waits for the spindle to return to a home position. From a prestored memory location, a rivet joint number is read in order to determine the prestored characteristics for that specific joint in the automotive vehicle or other workpiece (e.g., joint number 16 out of 25 total). Thus, the workpiece thickness, rivet length, rivet quality and force versus distance curves are recalled for comparison purposes for the joint to be riveted.

Next, the software determines if a rivet is present in the head based upon a proximity switch signal. If not, the feeder is energized to cause a rivet to be fed into the head. The spindle is then moved and the workpiece is clamped. The plate or workpiece thickness is then determined based on the load cell signals and compared against the recalled memory information setting forth the acceptable range. If the plate thickness is determined to be out of tolerance, then the riveting process is broken off or stopped. If the plate thickness is acceptable for that specific joint, then the rivet length is determined based on input signals from the load cell. If the punch force is too large, too soon in the stroke, then the rivet length is larger than an acceptable size, and vice versa for a small rivet. The riveting process is discontinued if the rivet length is out of tolerance.

The spindle is then retracted after the joint is completed. After the spindle is opened or retracted to the programmed home position, which may be different than the true and final home position, indicator signals are activated to indicate if the riveted joint setting is acceptable (OK), if the riveting cycle is complete (RC), and is ready for the next rivet setting cycle (reset OK). It should also be appreciated that various resolver signals and motor power consumption signals can also be used by second microprocessor 61 to indicate other quality characteristics of the joint although they are not shown in these flow diagrams. However such sensor readings would be compared against prestored memory values to determine whether to continue the riveting process, or discontinue the riveting process and send an error signal. Motor sensor readings can also be used to store and display cycle-to-cycle trends in data to an output device such as a CRT screen or printout.

FIG. 18*d* shows a separate software subroutine of error messages if the riveting process is broken off or discontinued. For example, if the plate thickness is unacceptable, then an error message will be sent stating that the setting is not okay (NOK) with a specific error code. Similarly, if the rivet length was not acceptable then a not okay setting signal will be sent with a specific error code. If another type of riveting fault has been determined then another rivet setting not okay signal will be sent and a unique error code will be displayed.

Figure 19:
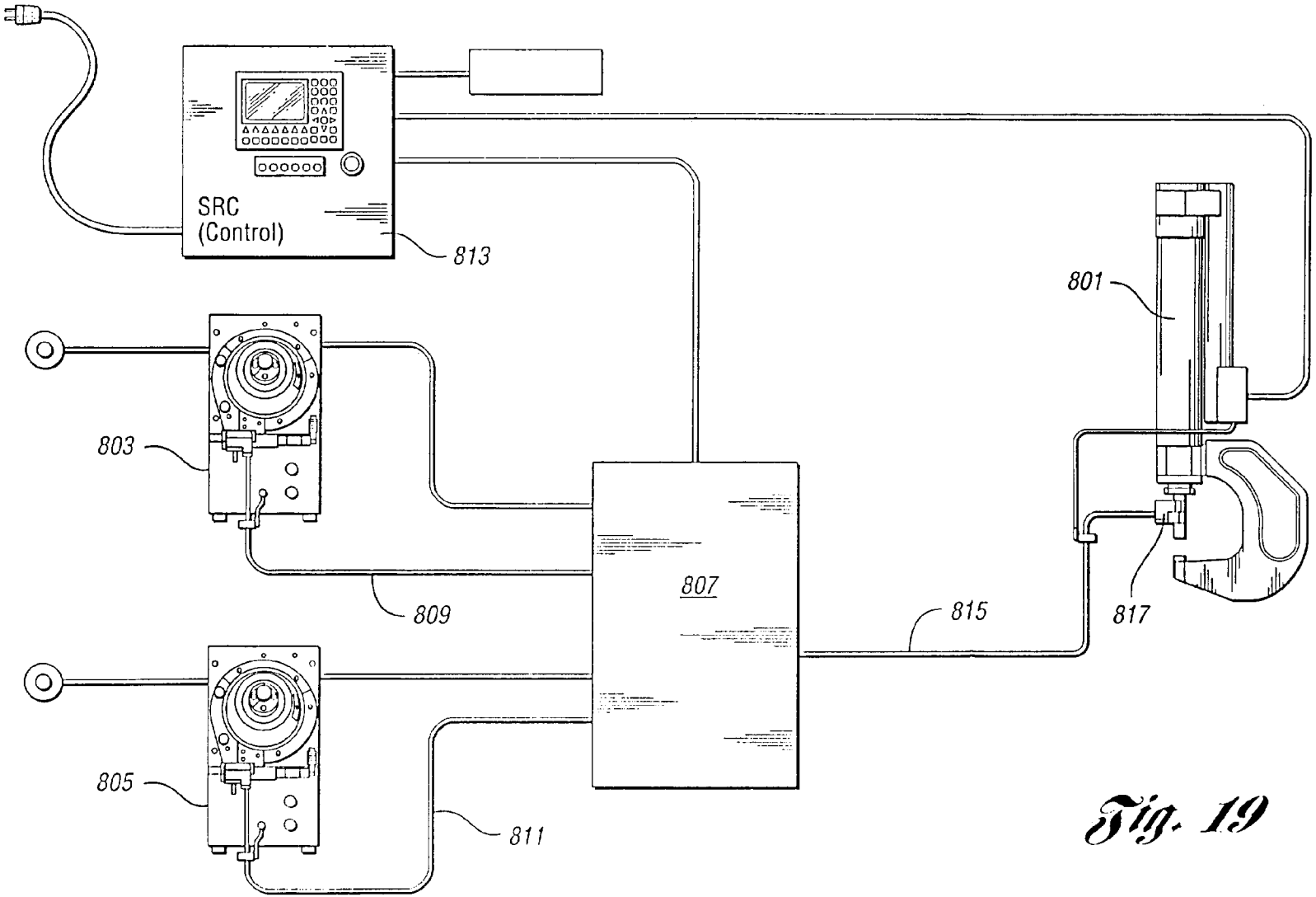
FIG. 19 is a partially diagrammatic, partially side elevational view showing a second alternate embodiment riveting system.

Another alternate embodiment riveting system is illustrated in FIG. 19. A robotically controlled riveting tool 801 is essentially the same as that disclosed with the preferred embodiment. However, two separate rivet feeders 803 and 805 are employed. Rivet feeders 803 and 805 are of the same general construction as that disclosed with the preferred embodiment, however, the rivet length employed in the second feeder 805 is longer (such as 5 millimeters in total length) than that in the first feeder 803 (such as a total rivet length of 3 millimeters). Each feeder 803 and 805 transmits the specific length rivets to a selector junction device 807 by way of separate input feed tubes 809 and 811. Selector device 807 has a pneumatically actuated reciprocating slide mechanism which is electrically controlled by a main electronic control unit 813. When main electronic control unit 813 recalls the specific joint to be worked on, it then sends a signal to selector device 807 as to which rivet length is needed. Selector device 807 subsequently mechanically feeds the correct rivet through a single exit feed tube 815 which is connected to a receiver 817 of riveting tool 801.

Thus, a single riveting tool can be used to rivet multiple joints having rivets of differing selected sizes or material characteristics without the need for complicated mechanical variations or multiple riveting tool set ups. The software program within main electronic control unit 813 can easily cause differing rivets to be sent to the single riveting tool 801, while changes can be easily made simply by reprogramming of the main electronic control unit. This saves space on the crowded assembly plant line, reduces mechanical complexity and reduces potential failure modes.

The accuracy of riveting, as well as measurements in the preferred embodiment, are insured by use of the highly accurate electric servo motor and rotary-to-linear drive mechanism employed. For example, the rivet can be inserted into the workpieces with one tenth of a millimeter of accuracy. The control system of the present invention also provides a real time quality indication of the joint characteristics, rather than the traditional random sampling conducted after many hundreds of parts were improperly processed. Thus, the present invention achieves higher quality, greater consistency and lower cost riveted joints as compared to conventional constructions.

While various embodiments have been disclosed, it will be appreciated that other configurations may be employed within the spirit of the present invention. For example, the spindle and punch holder may be integrated into a single part. Similarly, the nose piece and clamp can be incorporated into a single or additional parts. Belleville springs may be readily substituted for compression springs. Additional numbers of reduction gears or planetary gear types can also be used if a gear reduction ratio is other than that disclosed herein; however, the gear types disclosed with the preferred embodiment of the present invention are considered to be most efficiently packaged relative to many other possible gear combinations. A variety of other sensors and sensor locations may be employed beyond those specifically disclosed as long as the disclosed functions are achieved. Additionally, analog or other digital types of electronic control systems, beyond microprocessors, can also be used with the riveting tool of the present invention. The electronic control units of the monitor and delivery module can be part of or separate from the main electronic control unit. It is also envisioned that more than two workpiece sheets can be joined by the present invention, and that the workpieces may be part of a microwave oven, refrigerator, industrial container or the like. While various materials and dimensions have been disclosed, it will be appreciated that other materials and dimensions may be readily employed. It is intended by the following claims to cover these and any other departures from the disclosed embodiments which fall within the true spirit of this invention.

The invention claimed is:

1. Computer software stored in memory for use in a workpiece riveting process having workpieces, a rivet, a riveting tool, a rivet feeder and an electronic control unit, the software comprising:

(a) a first software instruction set operably determining if the rivet is located in the riveting tool;

(b) a second software instruction set operably sending a signal to feed the rivet to the riveting tool if step (a) is negative;

(c) a third software instruction set operably energizing an actuator of the riveting tool to advance the rivet;

(d) a fourth software instruction set operably measuring the thickness of at least one of the workpieces;

(e) a fifth software instruction set operably determining if the thickness is acceptable;

(f) a sixth software instruction set operably determining a size characteristic of the rivet; and (g) a seventh software instruction set operably determining the force used to join the workpieces by the rivet.

2. The software of claim 1 wherein the actuator is an electric motor, further comprising an eighth software instruction set operably deenergizing the electric motor if an unacceptable condition is determined.

3. The software of claim 1 further comprising an eighth software instruction set operably sending an error signal if an unacceptable condition is determined.

4. The software of claim 1 further comprising an eighth software instruction set operably storing determined values and displaying historical trends between riveting process cycles.

5. The software of claim 1 further comprising an eighth software instruction set operably determining which rivet should be fed to the riveting tool from multiple different rivet options.

6. The software of claim 1 further comprising an eighth software instruction set operably causing rotation of the actuator which linearly drives the rivet into the workpieces in a self-piercing manner and substantially prevents the rivet from completely piercing through a die side one of the workpieces.

7. A riveting process employing a self-piercing rivet, a joint and an electric motor, the process comprising:

(a) recalling data about the joint to be riveted;

(b) energizing the electric motor and causing rotary motion of the motor to linearly advance the self-piercing rivet;

(c) using a real-time sensed signal input which indicates the length of the self-piercing rivet;

(d) comparing the sensed signal input to the recalled data; and (e) deenergizing the electric motor to prevent the self-piercing rivet from completely piercing through a die-side workpiece.

8. The process of claim 7 wherein the sensed signal input is transmitted from a sensor located in the riveting tool indicating a riveted characteristic.

9. The process of claim 7 wherein another sensed signal input indicates the thickness of at least two workpieces riveted together by the self-piercing rivet.

10. The process of claim 7 wherein another sensed signal input indicates the quality of the riveted joint.

11. The process of claim 7 wherein another sensed signal input indicates the quantity of force applied by a punch.

12. The process of claim 7 further comprising receiving a signal responsive to a force applied by a clamp linearly advancing at least partially with a punch, to a workpiece being riveted.

13. The process of claim 7 further comprising deenergizing the electric motor and sending an error signal if an undesirable riveted characteristic is determined.

14. The process of claim 7 further comprising allowing the riveting process to operate in a subsequent riveting cycle if an acceptable riveted characteristic is determined.

15. The process of claim 7 further comprising causing a robot to move a riveting tool including the electric motor and a punch.

16. The process of claim 7 further comprising determining the actual torque of the electric motor and comparing the actual torque to a desired torque.

17. The process of claim 7 further comprising determining the actual speed of the electric motor and comparing the actual speed to a desired speed.

18. The process of claim 7 further comprising determining the actual electrical power characteristic of the electric motor and comparing the actual electrical power characteristic to a desired electrical power characteristic.

19. Computer software stored in memory for use in a workpiece fastening process having at least one workpiece, a fastener and a fastening tool, the fastening tool including an actuator and a punch, the software comprising:

(a) first software instructions being operable to energize the actuator in order to advance the punch and drive the fastener into a solid area of the workpiece in a fluid-free manner;

(b) second software instructions being operable to determine if a portion of the fastener is substantially flush with an exterior surface of the workpiece; and (c) third software instructions being operable to control energization of the actuator in order to stop advancement of the punch when the desired flushness of the fastener portion relative to the workpiece is determined.

20. The software of claim 19 wherein the fastener is a rivet.

21. The software of claim 20 wherein the rivet is a diverging and self piercing rivet that at least one of the software instructions prevent from being driven through a die-side workpiece.

22. The software of claim 19 wherein the actuator is an electric motor and the fastening tool is free of fluid actuation.

23. The software of claim 22 further comprising at least one gear operably rotated by the electric motor when energized by the first software instructions, and a transmission operably converting rotary motion of the gear to linear advancing motion of the plunger.

24. The software of claim 19 further comprising fourth software instructions operably comparing a sensed fastening characteristic to a desired fastening characteristic and automatically varying a feature associated with moving the punch if the compared differences do not equal at least one value.

25. The software of claim 24 wherein the varied feature associated with moving the punch includes varying the advancing distance from that initially desired of the punch.

26. The software of claim 19 further comprising fourth software instructions operably measuring the thickness of the at least one workpiece.

27. The software of claim 19 further comprising fourth software instructions operably determining the force used to join multiples of the workpiece together by the fastener and automatically varying a feature associated with the fastening tool in response to the force determined.

28. A computer program stored on a medium for use in a riveting process employing a fastener, at least a die-side workpiece, a joint in the workpiece and an electric motor, the program comprising:

(a) a first set of computer instructions operably recalling data about the joint to be riveted;

(b) a second set of computer instructions operably energizing the electric motor and causing rotary motion of the motor to linearly advance the fastener;

(c) a third set of computer instructions operably using a real-time sensed signal input;

(d) a fourth set of computer instructions operably comparing the sensed signal input to the recalled data;

(e) a fifth set of computer instructions operably controlling the electric motor to prevent the fastener from completely piercing through the die-side workpiece; and (f) a set of instructions causing a robot to move a fastening tool including the electric motor, a non-fluid transmission and a punch the motor operably driving the transmission, the transmission operably driving the punch and the punch operably advancing the fastener into the workpiece.

29. The program of claim 28 wherein the sensed signal input is transmitted from a sensor operably indicating a characteristic of the fastener.

30. The program of claim 28 wherein the sensed signal input indicates the thickness of at least two of the workpieces secured together by the fastener.

31. The program of claim 28 wherein the sensed signal input indicates the length of the fastener.

32. The program of claim 28 wherein the sensed signal input indicates the quality of the fastener joint.

33. The program of claim 28 wherein the sensed signal input indicates the quantity of force applied by the punch driven by the motor.

34. The program of claim 28 further comprising receiving a signal responsive to a force applied by a clamp to the workpiece being attached to the fastener.

35. The program of claim 28 further comprising programming operatively deenergizing the electric motor and sending an error signal if an undesirable fastener characteristic is determined.

36. The program of claim 28 further comprising programming operatively allowing the riveting process to operate in a subsequent riveting cycle if an acceptable fastener characteristic is determined.

37. The program of claim 28 further comprising programming operatively determining the actual torque of the electric motor and comparing the actual torque to a desired torque.

38. The program of claim 28 further comprising programming operatively determining the actual speed of the electric motor and comparing the actual speed to a desired speed.

39. The program of claim 28 further comprising programming operatively determining the actual electrical power characteristic of the electric motor and comparing the actual electrical power characteristic to a desired electrical power characteristic.

40. The program of claim 28 wherein the fastener is a self-piercing rivet and the recalled data relates to riveting joint values.

41. A method of manufacturing by operating computer software for use in a workpiece riveting process having a self-piercing rivet and a riveting tool, the tool including an electromagnetic actuator, a fluid-free transmission and a punch, the method comprising:

(a) energizing the actuator of the riveting tool and advancing the self-piercing rivet with first software instructions;

(b) determining the actual electrical power characteristic of the electric motor and comparing the actual electrical power characteristic to a desired electrical power characteristic;

(c) automatically causing an exterior head surface of the self-piercing rivet to be substantially co-planar with a punch-side workpiece;

(d) automatically storing the determined characteristic values and displaying historical trends between riveting process cycles; and (e) causing rotation of a portion of the electromagnetic actuator which drives the fluid-free transmission in order to linearly drive the punch.

42. The method of claim 41 further comprising:

(a) determining thickness of at least the workpiece; and (b) determining if the workpiece thickness is acceptable, and if not, varying the riveting process.

43. The method of claim 41 further comprising sending an error signal if an unacceptable characteristic is determined.

44. The method of claim 41 further comprising automatically determining which rivet should be fed to the riveting tool from multiple different rivet options.

45. The method of claim 41 wherein the riveting characteristic is rivet size.

46. The method of claim 41 further comprising:

(a) causing rotation of a portion of the electromagnetic actuator which drives the fluid-free transmission in order to linearly drive the punch; and (b) always maintaining alignment of a die with the punch during all operations of the actuator.

47. The method of claim 41 further comprising determining the force needed to joint workpieces by the rivet, and if unacceptable, varying the riveting process while continuing to advance the rivet.

48. A method of manufacturing by operating computer software for use in a workpiece fastening process having a self-piercing fastener and a fastening tool, the tool including an electric motor and a transmission, the method comprising:

(a) energizing the electric motor of the fastening tool which drives the transmission in a fluid-free manner in order to advance the self-piercing fastener, with at least a first portion of the software;

(b) determining a fastening characteristic, and if unacceptable, automatically varying the fastening process, with at least a second portion of the software, the fastening characteristic comprising thickness of the at least one workpiece;

(c) determining if the workpiece thickness is acceptable, and if not, automatically varying the fastener process; and (d) determining the force needed to join at least one workpiece by the self-piercing fastener, and if unacceptable, varying the fastening process, with at least a third portion of the software.

49. The method of claim 48 further comprising controlling the tool to rivet the fastener to the least one workpiece.

50. The method of claim 49 further comprising controlling the tool to self pierce a punch-side workpiece and to not completely pierce through a die-side workpiece.

51. The method of claim 48 further comprising controlling the tool to cause rotation of a portion of the electric motor which linearly drives a fastener punch.

* * * * *

UNITED STATES PATENT AND TRADEMARK OFFICE

CERTIFICATE OF CORRECTION

PATENT NO. : 7,024,270 B2
APPLICATION NO. : 10/300317
DATED : April 4, 2006
INVENTOR(S) : Dieter Mauer et al.

It is certified that error appears in the above-identified patent and that said Letters Patent is hereby corrected as shown below:

Title Page,
Item [56] References Cited, U.S. PATENT DOCUMENTS, page 2,
"3,811,813" should be -- 3, 811,313 --.

Column 14,
Line 48, after "comprising" insert -- programming operatively --.

Column 16,
Line 5, "joint" should be -- join --.
Line 33, after "to the" insert -- at --.

Signed and Sealed this

Fifth day of September, 2006

JON W. DUDAS
*Director of the United States Patent and Trademark Office*